US007628648B1

(12) United States Patent
Tan Chin Yaw et al.

(10) Patent No.: US 7,628,648 B1
(45) Date of Patent: Dec. 8, 2009

(54) TERMINAL POSITION ASSURANCE DEVICE AND A CONNECTOR ASSEMBLY EMPLOYING THE SAME

(75) Inventors: Tommy Tan Chin Yaw, Singapore (SG); Gary Lim Meng Cher, Singapore (SG)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/271,188

(22) Filed: Nov. 14, 2008

(51) Int. Cl.
*H01R 13/40* (2006.01)

(52) U.S. Cl. ..... 439/595

(58) Field of Classification Search ..... 439/595, 439/752, 744
See application file for complete search history.

(56) References Cited

U.S. PATENT DOCUMENTS

| | | | | |
|---|---|---|---|---|
| 5,595,509 | A | 1/1997 | Fry et al. | |
| 5,782,657 | A | 7/1998 | Wolla et al. | |
| 6,200,164 | B1 | 3/2001 | Martin et al. | |
| 6,599,150 | B1 | 7/2003 | Martin et al. | |
| 7,044,808 | B1 | 5/2006 | Foltz et al. | |
| 7,063,578 | B2 | 6/2006 | Goto | |
| 7,077,701 | B2 | 7/2006 | Martin | |
| 7,118,417 | B2 * | 10/2006 | Aihara et al. | 439/595 |
| 7,252,557 | B2 * | 8/2007 | Nakamura et al. | 439/752 |
| 2003/0087563 | A1 * | 5/2003 | Endo | 439/752 |
| 2007/0128953 | A1 * | 6/2007 | Ciriello et al. | 439/752 |

* cited by examiner

*Primary Examiner*—Phuong K Dinh
(74) *Attorney, Agent, or Firm*—Rader, Fishman & Grauer PLLC

(57) ABSTRACT

A terminal position assurance device includes a housing and a matrix body. The housing having a parallelepiped configuration and defining a housing cavity has a forwardly-projecting U-shaped member that defines a U-shaped recess portion of the housing cavity. The U-shaped member has an opposing pair of free end latch portions. Respective ones of the free end latch portions and respective top and bottom walls are separated from one other by a slot formed therebetween. The matrix body disposed in the housing cavity has a plurality of matrix tubes. Each matrix tube defines a matrix passageway. The U-shaped member is disposed forward of the matrix body in the longitudinal direction. The matrix tubes are formed by a series of horizontal wall sections and vertical wall sections. Each one of the vertical wall sections includes a terminal retainer tab projecting laterally into respective ones of the matrix passageways.

19 Claims, 26 Drawing Sheets

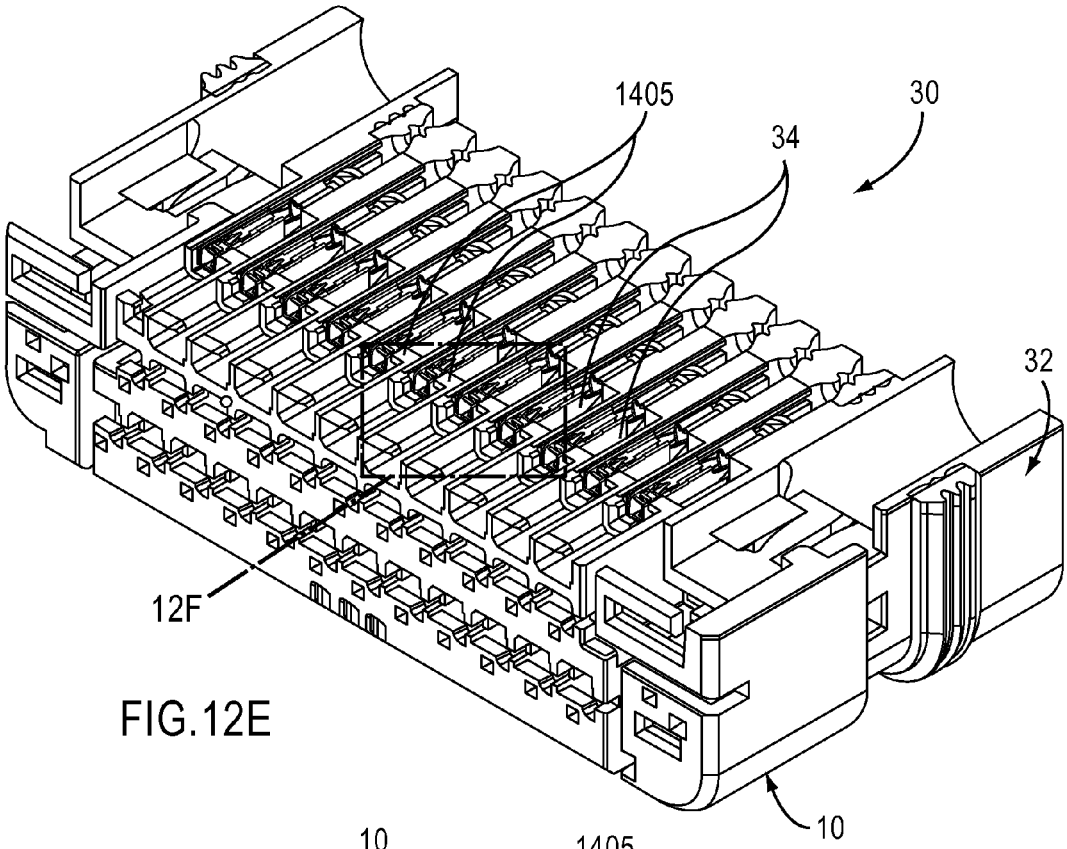
FIG.12E
FIG.12F
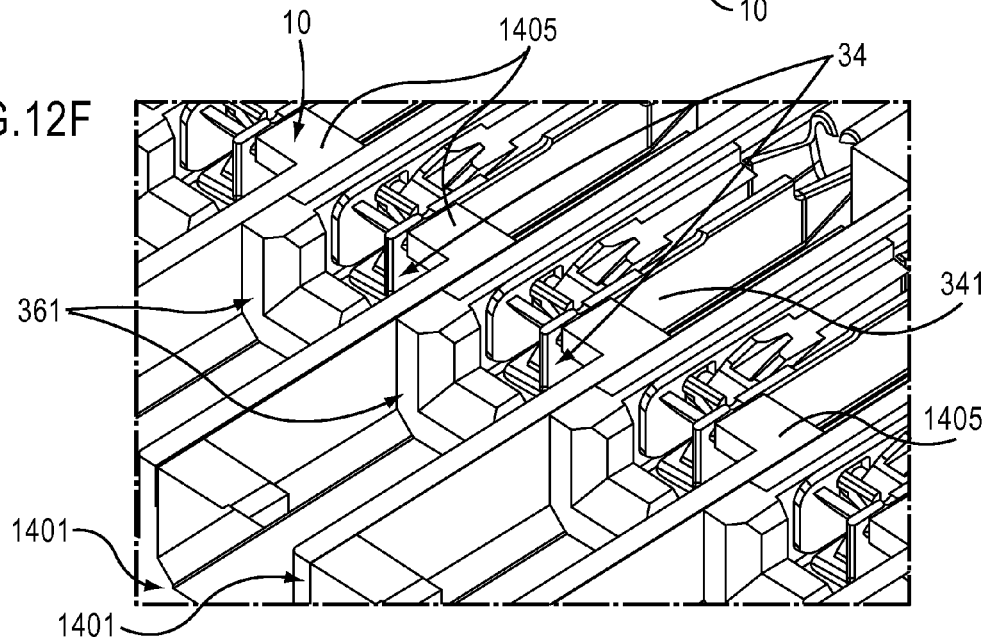

TERMINAL POSITION ASSURANCE DEVICE AND A CONNECTOR ASSEMBLY EMPLOYING THE SAME

FIELD OF THE INVENTION

The present invention relates to a terminal position assurance device. More particularly, the present invention is directed to a terminal position assurance device used in combination with an electrical connector.

BACKGROUND OF THE INVENTION

Terminal position assurance devices are commonly known in the electrical connector industry. Generally, there are two types of terminal position assurance devices, namely, a front-load type terminal position assurance device and a side/top load type terminal position assurance device.

For the front-load type terminal position assurance device, the terminal position assurance device effectively prevents a resiliently-biased lance member from deflecting within the female terminal connector when all of the female terminals are properly inserted into the female terminal connector. However, in the event that one or more of the female terminals are only partially inserted into the female terminal connector and, thus, improperly inserted thereinto, the terminal position assurance device might also prevent the resiliently-biased lance member from deflecting with the female terminal connector but, poor connectivity might result upon insertion of the male terminal into the female terminal. Thus, it is possible that the terminal position assurance device moves to its final lock position even though the female terminals are only partially and, thus, improperly inserted into the female terminal connector.

For the side/top load type terminal position assurance device, a channel must be formed across with female terminal connector with the female terminal connectors properly inserted therein. In the event that the female terminals are not properly inserted into the female terminal connector, as described above, the side/top load type terminal position assurance device cannot be inserted completely through the channel. Thus, it can be determined that one or more female terminals are not properly inserted into the female terminal connector. Only when all of the female terminals are properly inserted into the female terminal connector will the side/top load type terminal position assurance device extend through the female terminal connector. In this manner, it is possible to detect that the female terminals are not properly inserted into the female connector. However, the side/top load type terminal position assurance device and the female terminal connector is difficult to manufacture.

SUMMARY OF THE INVENTION

One exemplary embodiment of a terminal position assurance device of the present includes a housing and a matrix body. The housing extends along and about a longitudinal axis defining a longitudinal direction, a lateral axis defining a lateral direction and a transverse axis defining a transverse direction. The longitudinal axis, the lateral axis and the transverse axis perpendicularly intersect one another. The housing has a U-shaped member, a top wall, a bottom wall extending parallel to the top wall and a pair of side walls. The pair of side walls are disposed apart from and extend generally parallel to one another. Also, the pair of side walls interconnect the top and bottom walls to form a generally parallelepiped configuration to define a housing cavity extending in the longitudinal direction. The U-shaped member has a base extending in the transverse direction and a pair of arms. The pair of arms extend generally parallel to each other in the lateral direction and generally perpendicularly to the base member. Each arm has a fixed arm portion and a free end latch portion integrally connected to the fixed arm portion. The base is integrally formed with one of the pair of side walls and respective ones of the fixed arm portions are integrally formed with respective ones of the top and bottom walls. Also, respective ones of the free end latch portions and the top and bottom walls are separated from one other by a slot formed therebetween.

The matrix body is disposed in the housing cavity and has a plurality of matrix tubes. Each matrix tube defines a matrix passageway that extends therethrough in the longitudinal direction. The U-shaped member is disposed forward of the matrix body in the longitudinal direction to form a U-shaped recess portion of the housing cavity. In other words, the U-shaped recess portion of the housing cavity is disposed forwardly of the matrix body.

Another exemplary embodiment of the present invention is a connector assembly. The connector assembly includes the terminal position assurance device as described above and a terminal connector includes a terminal connector housing and a plurality of female terminals affixed thereto. The terminal connector housing has a parallelepiped configuration. The plurality of female terminal-receiving channel members are arranged in general registration with the plurality of matrix passageways so that the terminal position assurance device and the terminal connector can be connected together as described in more detail below. Respective ones of the female terminals are disposed in respective ones of the plurality of the female terminal-receiving channel members. Each female terminal has a U-shaped front portion and a U-shaped stepped-down rear portion is integrally connected to the U-shaped front portion to form a pair of stop walls. The pair of stop walls are located rearwardly of the U-shaped front portion adjacent the U-shaped stepped-down rear portion. The terminal connector has an insertion part with a wall formed with a guide slot, a first indentation and a second indentation. The second indentation is disposed apart from and extends parallel to the first indentation in a juxtaposed manner.

To connect the terminal position assurance device to the terminal connector, the terminal position assurance device serially moves relative to the terminal connector from an initial alignment position, to a pre-lock position, to an initial lock position and to a final lock position. In the initial alignment position, respective ones of the locking tabs are positioned to align with respective ones of the guide slots and respective ones of the plurality of matrix tubes are positioned to align with respective ones of the plurality of female terminal-receiving channel members. In the pre-lock position, respective ones of the locking tabs are slidably received in respective ones of the guide slots. Also, a forward portion of the insertion part is received in the U-shaped recess portion of the housing cavity and respective ones of the plurality of female terminal-receiving channel members are partially received in respective ones of the plurality of matrix tubes and respective ones of the terminal retainer tabs are positioned juxtaposed to respective ones of the U-shaped front portions of the female terminals.

From the pre-lock position to the initial lock position, a first force in the longitudinal direction is applied in the longitudinal direction to cause respective ones of the free end latch portions to move from the normal state to the flexed state. Simultaneously therewith, respective ones of the locking tabs slide along the insertion part in the longitudinal direction and the plurality of matrix tubes advance onto the plurality of female terminal-receiving channels. In the initial lock position, respective ones of the locking tabs are received in respective ones of the first indentations in a close-fitting relationship. Further, respective ones of the terminal retainer tabs are rearwardly offset relative to the pair of stop walls in the longitudinal direction.

From the initial lock position to the final lock position, a second force is applied in the lateral direction to cause respective ones of the free end latch portions to move from the normal state to the flexed state. Simultaneously therewith, respective ones of the locking tabs slide along the insertion part in the lateral direction and the respective ones of the terminal retainer tabs move in a lateral direction behind at least one of the respective pairs of stop walls. In the final lock position, respective ones of the locking tabs are received in respective ones of the second indentations in a close-fitting relationship, the free end latch portions return to the normal state from the flexed state and respective ones of the terminal retainer tabs are disposed in a stationary position behind the at least one of the respective pairs of stop walls.

Accordingly, of the present invention is hereinafter described. Advantages of the present invention will be better appreciated in view of the detailed description of the exemplary embodiments of the present invention with reference to the accompanying drawings, in which:

BRIEF DESCRIPTION OF THE DRAWINGS

FIG. 12E is a perspective view of the terminal position assurance device and the terminal connector in the pre-lock position.

FIG. 12F is an enlarged partial perspective view taken from FIG. 12E.

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

A first exemplary embodiment of a terminal position assurance device 10 of the present invention is hereinafter described with reference to FIGS. 1-7. The terminal position assurance device 10 includes a housing 12 and a matrix body 14. For simplicity of the description of the present invention, the housing 12 extends along and about a longitudinal axis L which defines a longitudinal direction LD, a lateral axis R defines a lateral direction RD and a transverse axis T defines a transverse direction TD. The longitudinal axis L, the lateral axis R and the transverse axis T perpendicularly intersect one another to form a conventional Cartesian coordinate system.

Figure 1:
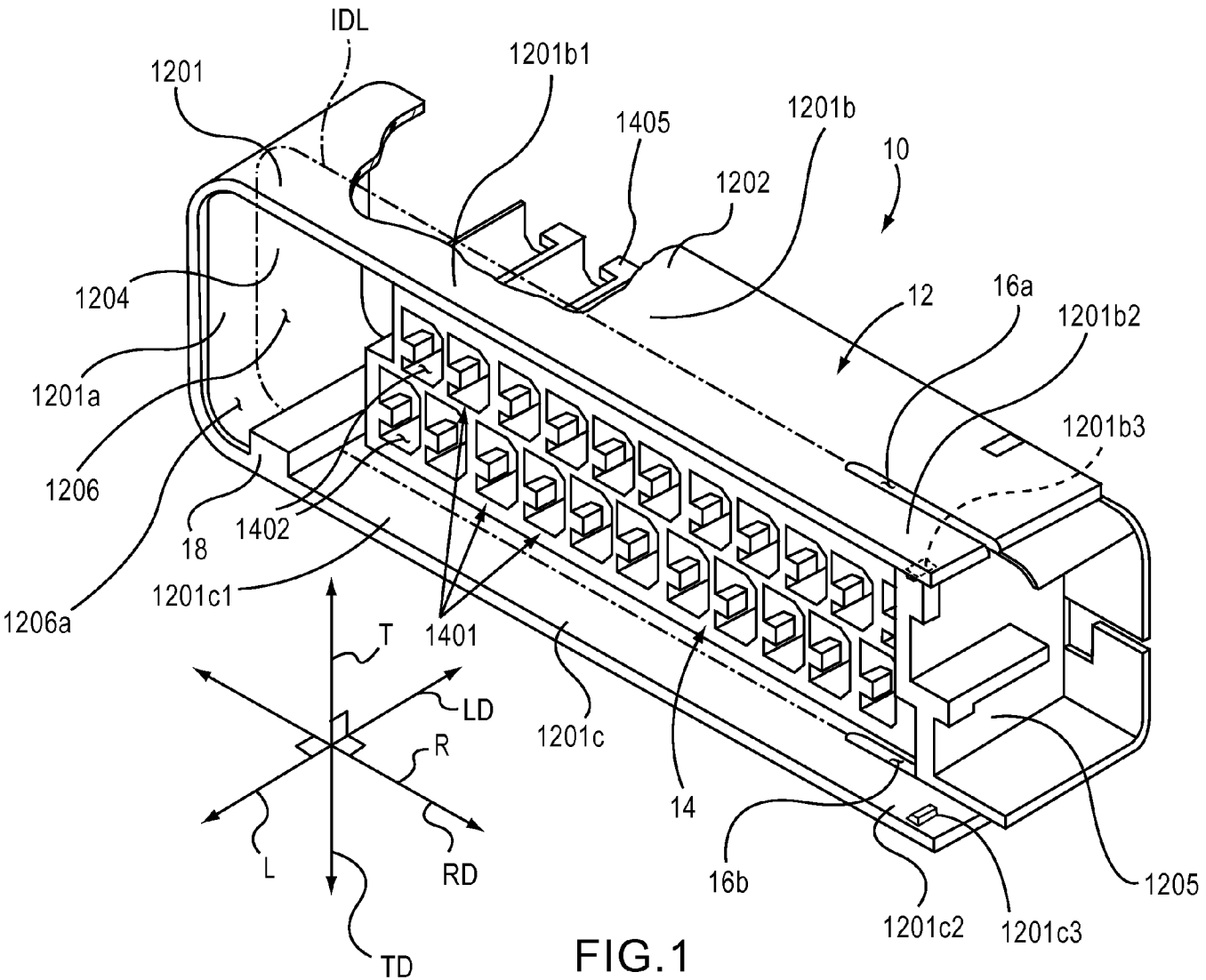
FIG. 1 is a perspective view partially broken away of an exemplary embodiment of a terminal position assurance device of the present invention.
Figure 2:
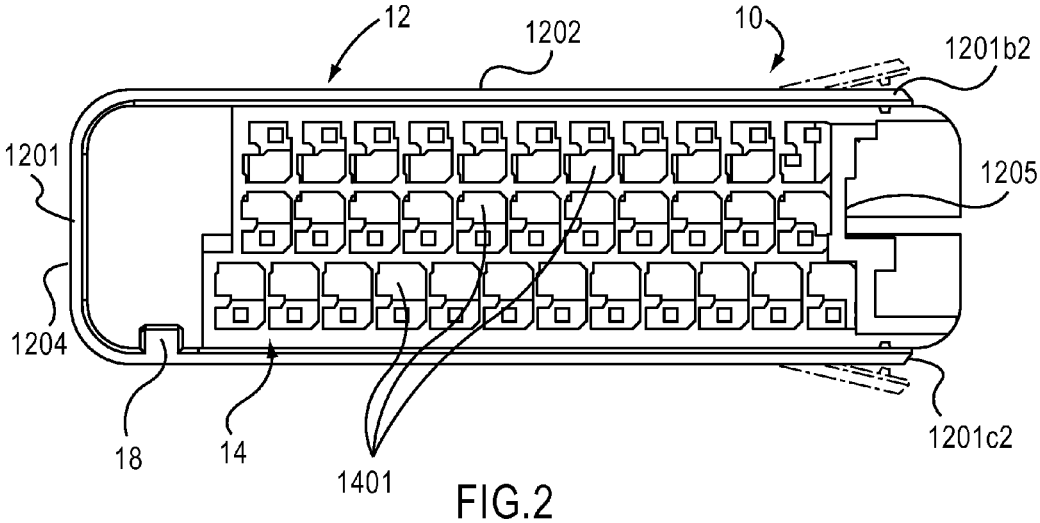
FIG. 2 is a front elevation view of the terminal position assurance device of the present invention.
Figure 3:
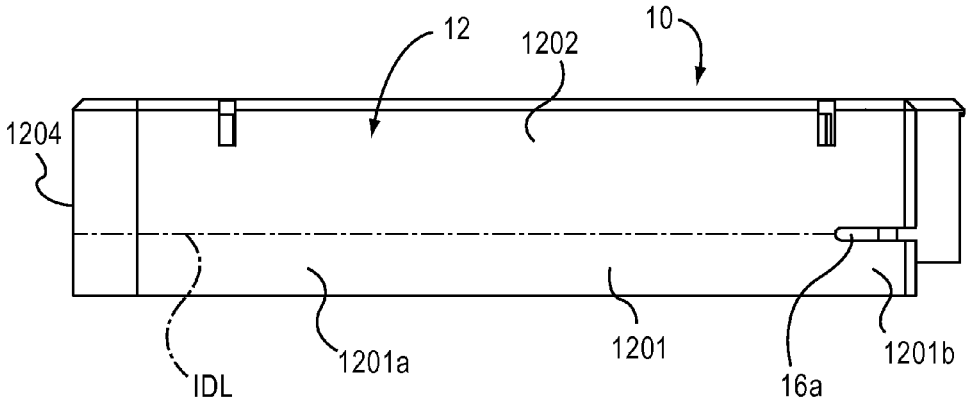
FIG. 3 is a top plan view of the terminal position assurance device of the present invention.
Figure 4:
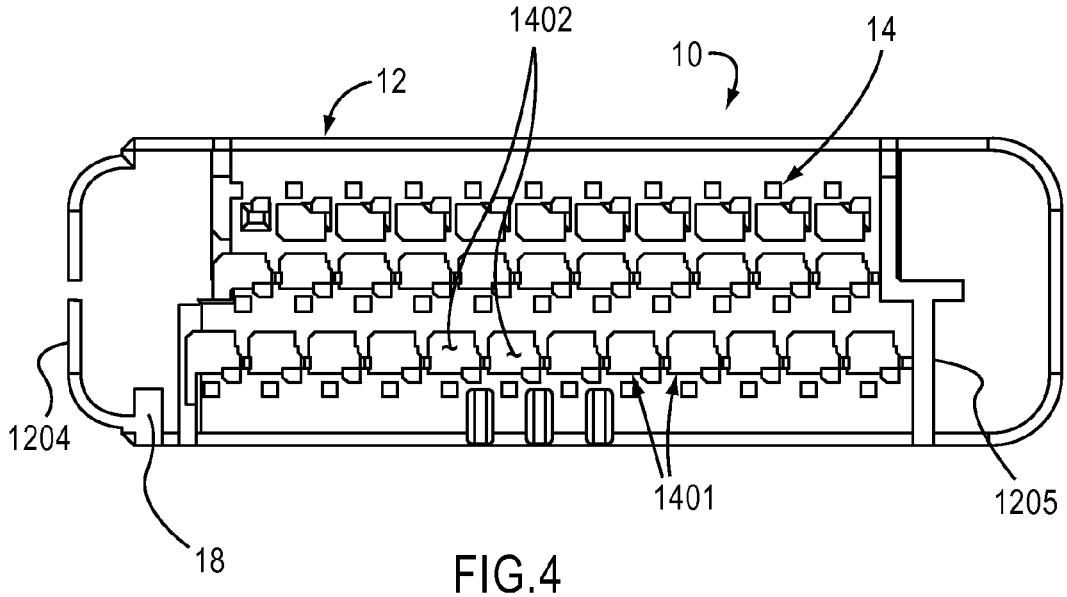
FIG. 4 is a rear elevational view of the terminal position assurance device of the present invention.
Figure 5:
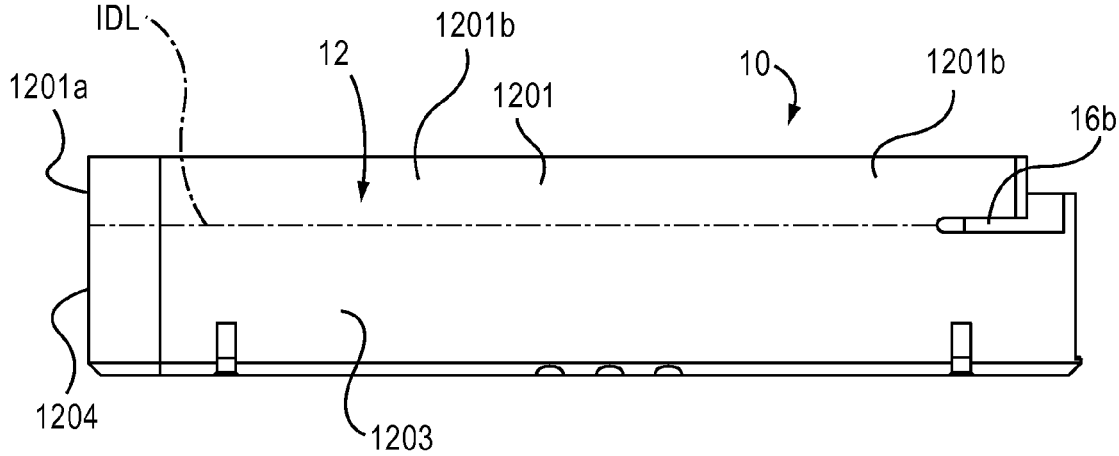
FIG. 5 is a top plan view of the terminal position assurance device of the present invention.
Figure 6:
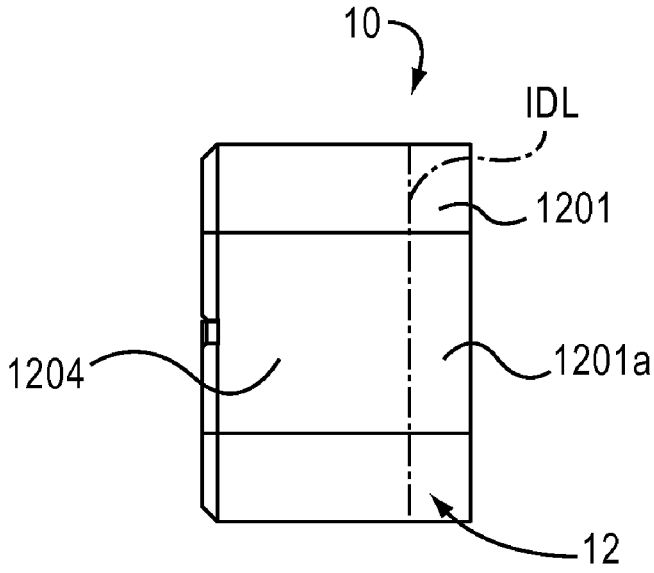
FIG. 6 is a right side elevational view of the terminal position assurance device of the present invention.
Figure 7:
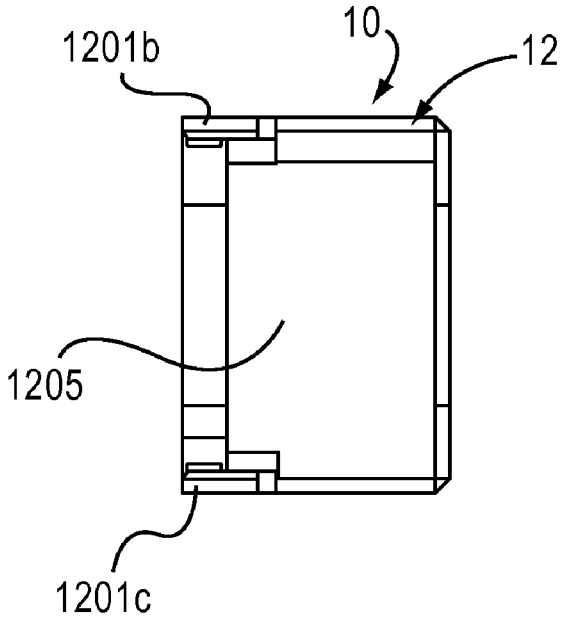
FIG. 7 is a left side elevational view of the terminal position assurance device of the present invention.

As shown in FIGS. 1-7, the housing 12 has a U-shaped member 1201, a top wall 1202, a bottom wall 1203 extending parallel to the top wall 1202 and a pair of side walls 1204 and 1205. Note that the U-shaped member 1201 is integrally connected to the top wall 102, the bottom wall 1203 and one of the pair of side walls, namely 1204 along the imaginary dashed line IDL. As best shown in FIGS. 2 and 4, the pair of side walls 1204 and 1205 are disposed apart from and extend generally parallel to one another. Also, the pair of side walls 1204 and 1205 interconnect the top and bottom walls 1202 and 1203 respectively to form a generally parallelepiped configuration (FIGS. 1-7) to define a housing cavity 1206 extending in the longitudinal direction LD.

As best shown in FIG. 1, the U-shaped member 1201 has a base 1201*a* extending in the transverse direction TD and a pair of arms 1201*b* and 1201*c*. The pair of arms 1201*b* and 1201*c* extend generally parallel to each other in the lateral direction LD and generally perpendicularly to the base member 1201*a*. Each arm 1201*b* and 1201*c* has a fixed arm portion 1201*b*1 and 1201*c*1 respectively and a free end latch portion 1201*b*2 and 1201*c*2. Respective ones of the free end latch portions 1201*b* and 1201*c* are integrally connected to respective ones of the fixed arm portions 1201*b*1 and 1201*c*1. The base 1201*a* is integrally formed with one of the pair of side walls, for example in this embodiment, side wall 1204 and respective ones of the fixed arm portions 1201*b*1 and 1201*c*1 are integrally formed with respective ones of the top and bottom walls 1202 and 1203 respectively. Also, respective ones of the free end latch portions 1201*b*2 and 1201*c*2 and the top and bottom walls 1202 and 1203 are separated from one other by respective slots 16*a* and 16*b* formed therebetween.

With reference to FIGS. 1, 2 and 4, the matrix body 14 is disposed in the housing cavity 1206 and has a plurality of hollow matrix tubes 1401. Each matrix tube 1401 defines a matrix passageway 1402 that extends therethrough in the longitudinal direction LD. The U-shaped member 1201 is disposed forward of the matrix body 14 in the longitudinal direction LD to form a U-shaped recess portion 1206*a* of the housing cavity 1206. In other words, the U-shaped recess portion 1206*a* of the housing cavity 1206 is disposed forwardly of the matrix body 14 in the longitudinal direction LD.

As illustrated in FIGS. 1 and 2, each one of the free end latch portions 1201*b*2 and 1201*c*2 has a locking tab 1201*b*3 and 1201*b*3 respectively. Respective ones of the locking tabs 1201*b*3 and 1201*c*3 extend in the longitudinal direction LD and project into the U-shaped recess portion 1206*a* of the housing cavity 1206. Further, each one of the free end latch portions 1201*b*2 and 1201*c*2 extends simultaneously in the lateral direction RD and the longitudinal direction LD. Also, the free end latch portions 1201*b*2 and 1201*c*2 extend parallel to one another in a normal state (shown in solid lines in FIG. 2). Additionally, each one of the free end latch portions 1201*b*2 and 1201*c*2 is operative to pivot generally transversely away from the U-shaped recess portion 1206*a* in a flexed state (shown in dashed lines in FIG. 2). However, each one of the free end latch portions 1201*b*2 and 1201*c*2 is and is resiliently biased to the normal state (shown in solid lines in FIG. 2).

Figure 8A:
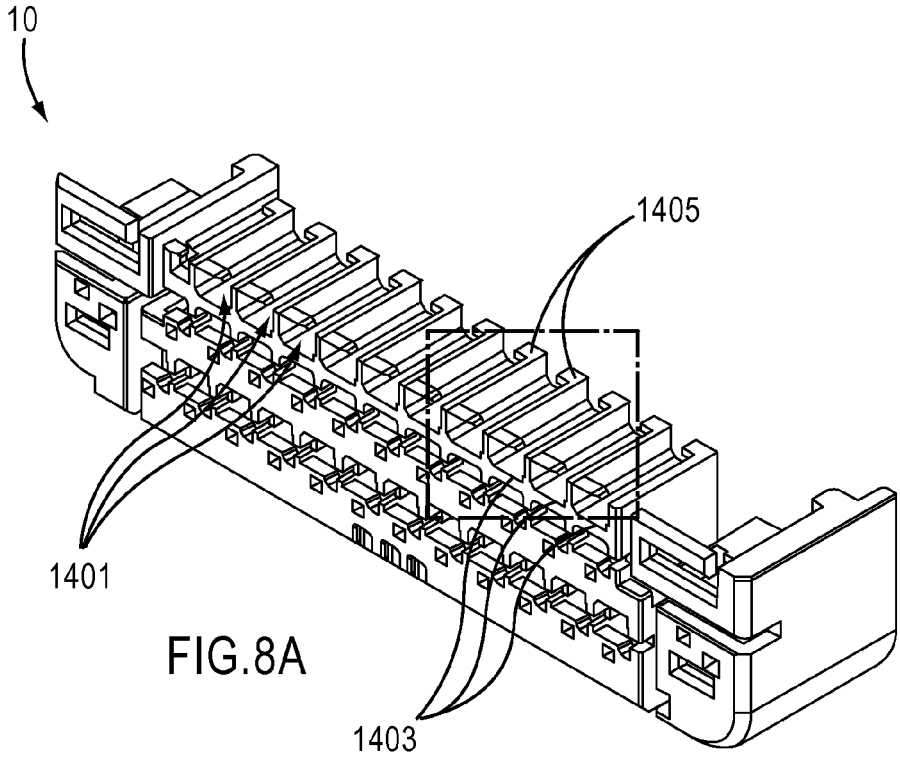
FIG. 8A is a perspective view partially broken away of the terminal position assurance device of the present invention.
Figure 8B:
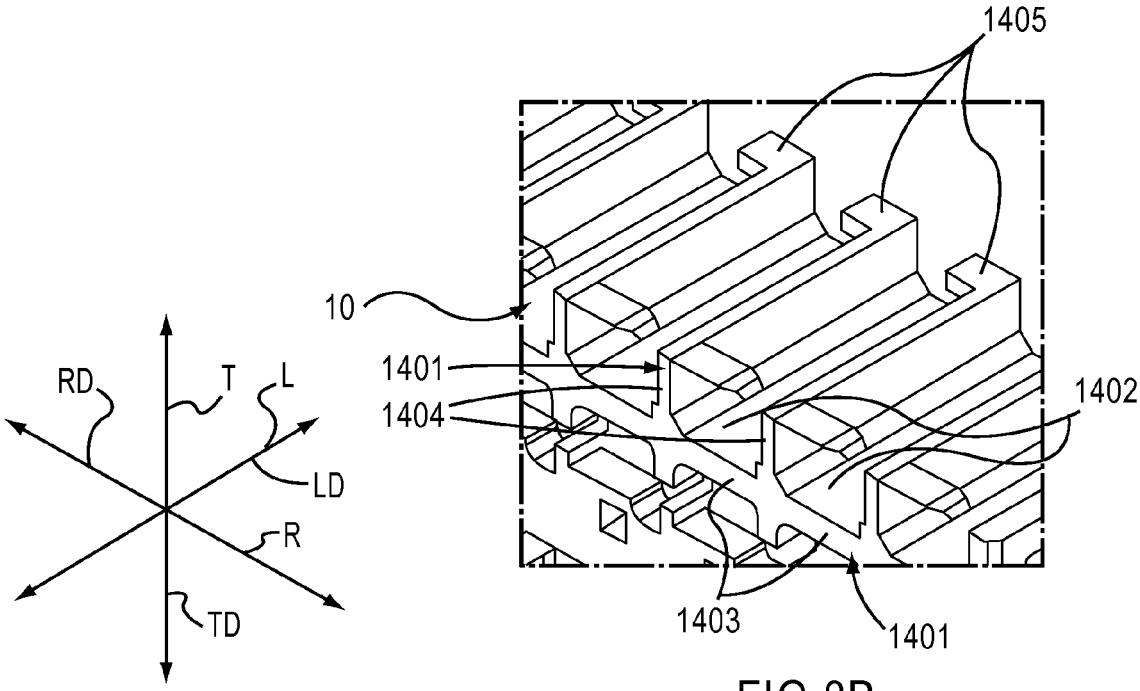
FIG. 8B is an enlarged partial perspective view taken from FIG. 8A of the terminal position assurance device of the present invention.

As best shown in FIGS. 8A and 8B, the plurality of matrix tubes 1401 is constructed from a series of horizontal wall sections 1403 and a series of vertical wall sections 1404. The horizontal wall sections 1403 are disposed apart from one another in the transverse direction TD and extend in the longitudinal LD and lateral directions RD. The series of vertical wall sections 1404 interconnect the series of horizontal wall sections 1403 and are disposed apart from one another in the lateral direction RD to form the respective matrix tubes 1401. Also, the series of vertical wall sections 1404 extend in the longitudinal direction LD and the transverse direction TD. Each one of the series of vertical wall sections 1404 includes a terminal retainer tab 1405 projecting laterally in the lateral direction RD and into respective ones of the matrix passageways 1402. Further, as best shown in FIG. 1, each one of the terminal retainer tabs 1405 is disposed rearwardly in the matrix body 14 relative to the U-shaped recess portion 1206*a*.

In FIGS. 1, 2 and 4, although not by way of limitation but by example only, the terminal position assurance device 10 also includes a guide rail 18. The guide rail 18 extends in the longitudinal direction LD and is disposed in at least the U-shaped recess portion 1206*a* of the housing cavity 1206. However, one of ordinary skill in the art would appreciate that the guide rail 18 may also extend into the contiguous portion of the housing cavity 1206 as illustrated.

In FIGS. 1 and 2, respective ones of the locking tabs 1201*b*3 and 1201*c*3 taper inwardly from respective ones of the free end latch portions 1201*b*3 and 1201*c*3 into the U-shaped recess portion 1206*a*. Also, respective ones of the locking tabs 1201*b*3 and 1201*c*3 are disposed forwardly in the longitudinal direction LD of the respective ones of the free end latch portions 1201*b*2 and 1201*c*2 and extend partially rearwardly in the longitudinal direction LD along the respective ones of the free end latch portions 1201*b*2 and 1201*c*2.

Figure 9A:
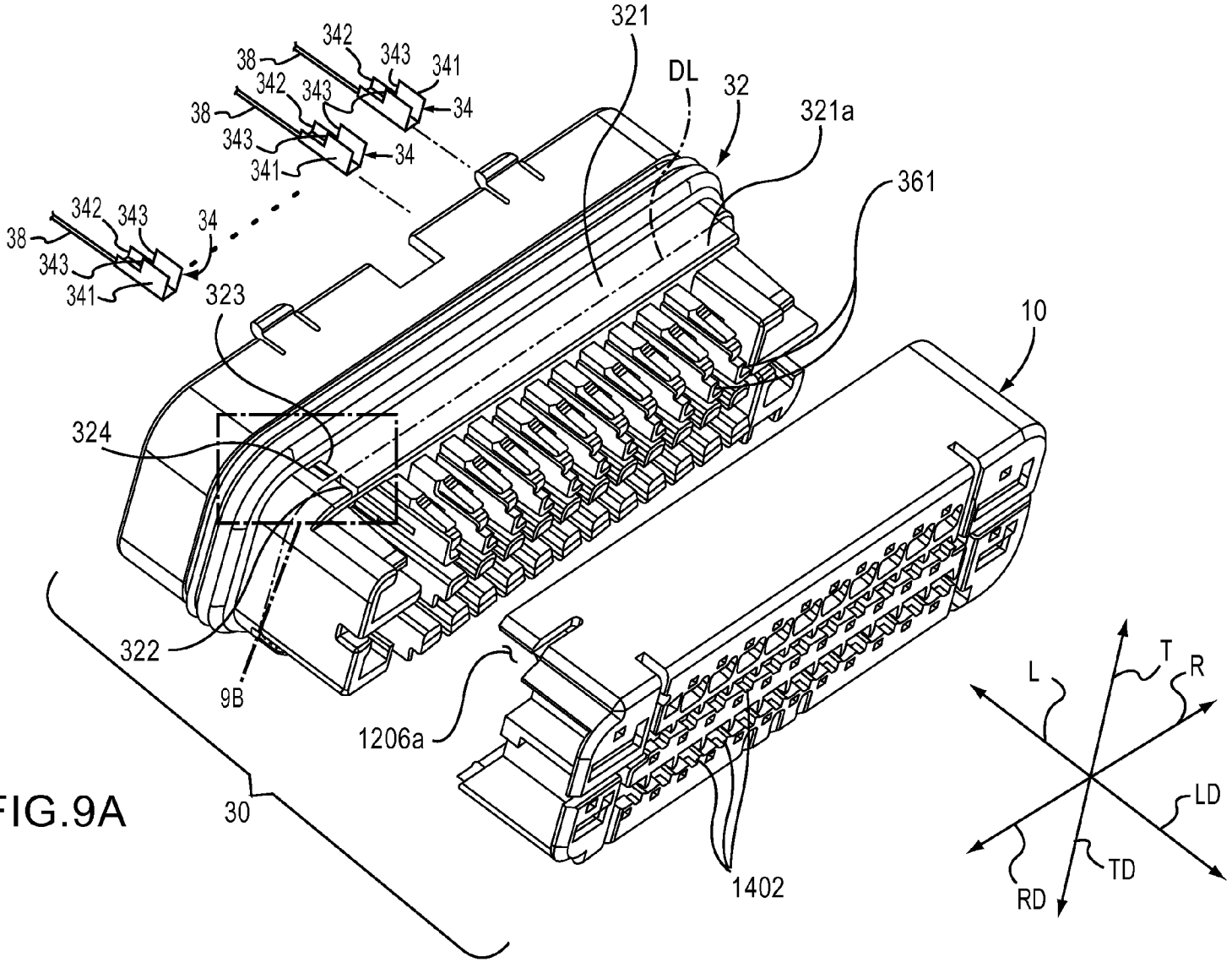
FIG. 9A is a top perspective view of another exemplary embodiment of a connector assembly of the present invention that includes a combination of the terminal position assurance device and a terminal connector.
Figure 9B:
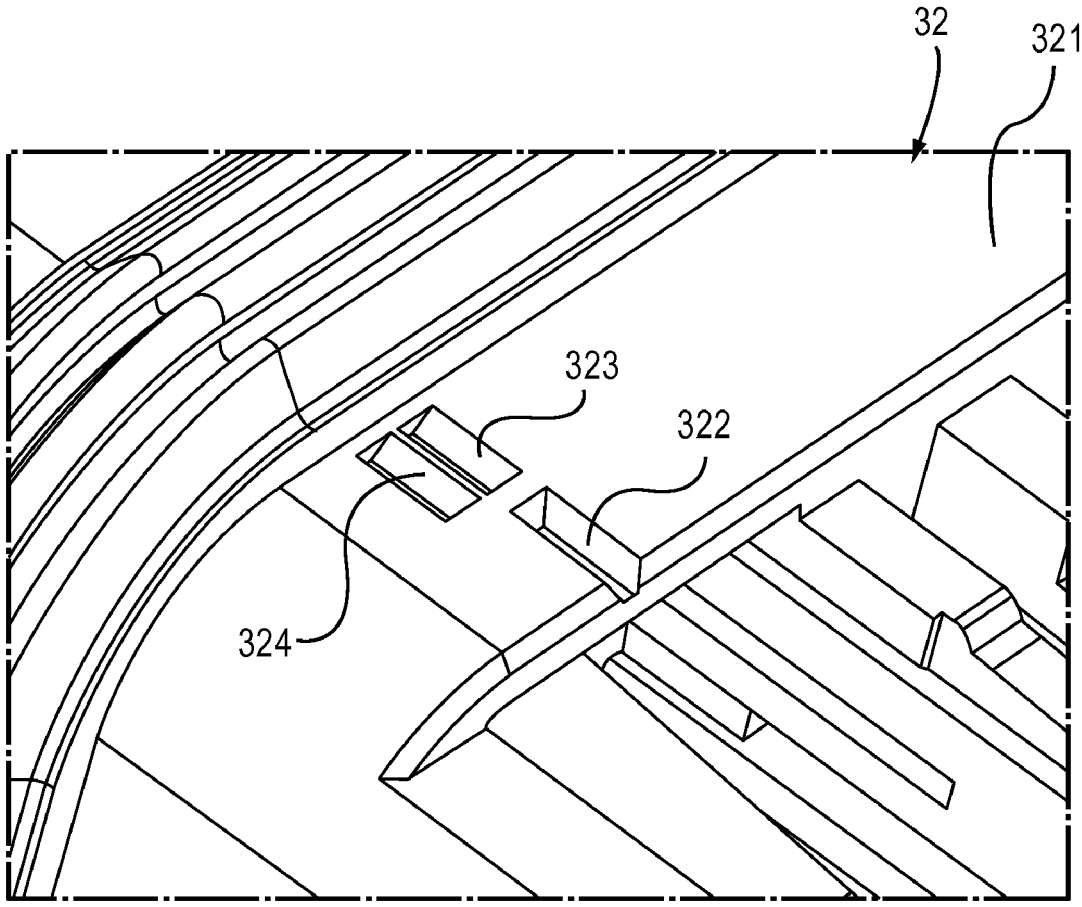
FIG. 9B is a top enlarged partial perspective view taken from FIG. 9A of the terminal connector.

Another exemplary embodiment of the present invention is a connector assembly 30 of the present invention as introduced in FIGS. 9A-16F. The connector assembly 30 includes the terminal position assurance device 10 of the present invention as described above, a terminal connector 32 and a plurality of female terminals 34. As best shown in FIGS. 10A and 11A, the terminal connector 32 includes a terminal connector housing 36 having a parallelepiped configuration and a plurality of female terminal-receiving channel members 361 with each defining a female terminal-receiving channel 362 extending therethrough in the longitudinal direction LD. In preparation of connecting the terminal position assurance device 10 and the terminal connector 32 together, the female terminal-receiving channel members 361 are arranged in general registration with the plurality of matrix passageways 1402 as best shown in FIG. 9A. The terminal connector 32 has an insertion part 321 with a wall formed with a pair of opposing guide slots 322, a pair of opposing first indentation 323 and a pair of opposing second indentations 324. Respective ones of the second indentations 324 are disposed apart from and extend parallel to the respective ones of the first indentations 323 in a juxtaposed manner.

In FIG. 9A, the plurality of female terminals 34 are conventional female terminals and, as best shown in FIGS. 12E and 12F, respective ones of the female terminals 34 are disposed and retained in respective ones of the plurality of the female terminal-receiving channel members 362. With reference to FIG. 9A, each female terminal 34 has a U-shaped front portion 341 and a U-shaped stepped-down rear portion 342 that integrally connected to the U-shaped front portion 341 to form a pair of stop walls 343. The pair of stop walls 343 are located rearwardly of the U-shaped front portion 341 adjacent the U-shaped stepped-down rear portion 342. A conventional wire 38 is typically soldered to the stepped-down rear portion 343.

FIGS. 9A-16F illustrate how to connect the terminal position assurance device 10 and the terminal connector 32 together with FIGS. 9A-10B showing the general relationship of the terminal position assurance device 10 and the terminal connector 32 just before their connection. In summary and by way of example only and not by way of limitation, the terminal position assurance device 10 serially moves relative to the terminal connector 32 from an initial alignment position (FIGS. 11A-11E), to a pre-lock position (FIGS. 12A-12F), to an initial lock position (FIGS. 14A-14F) and to a final lock position (FIGS. 16A-16F). Connecting the terminal position assurance device 10 and the terminal connector 32 is described in more detail immediately below.

Figure 10A:
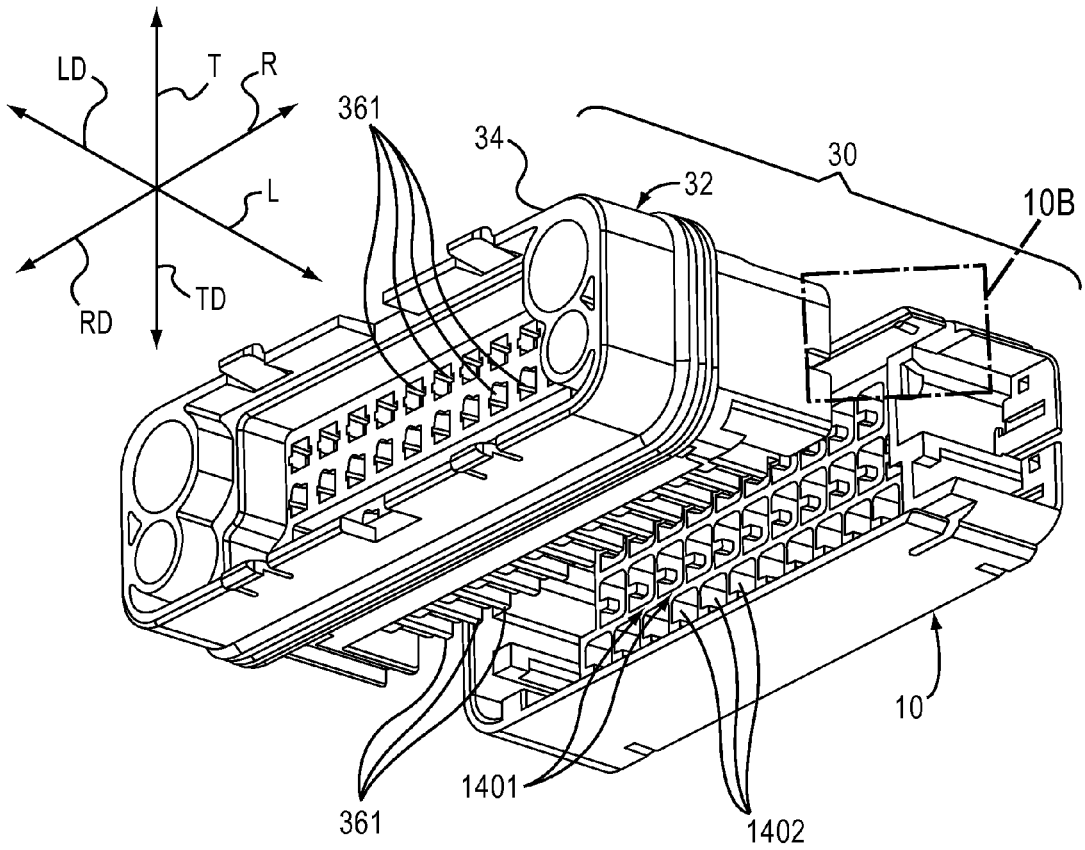
FIG. 10A is a bottom perspective view of the connector assembly of FIG. 9A.
Figure 10B:
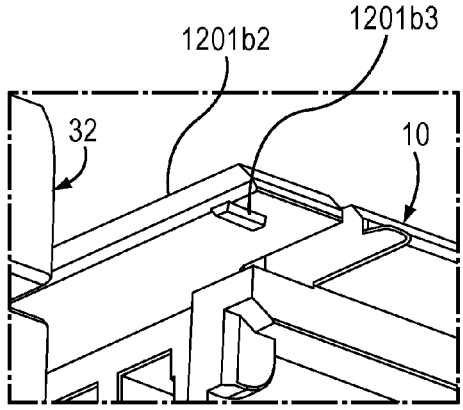
FIG. 10B is a bottom enlarged partial perspective view taken from FIG. 10A of a free end latch portion of the terminal position assurance device.
Figure 11A:
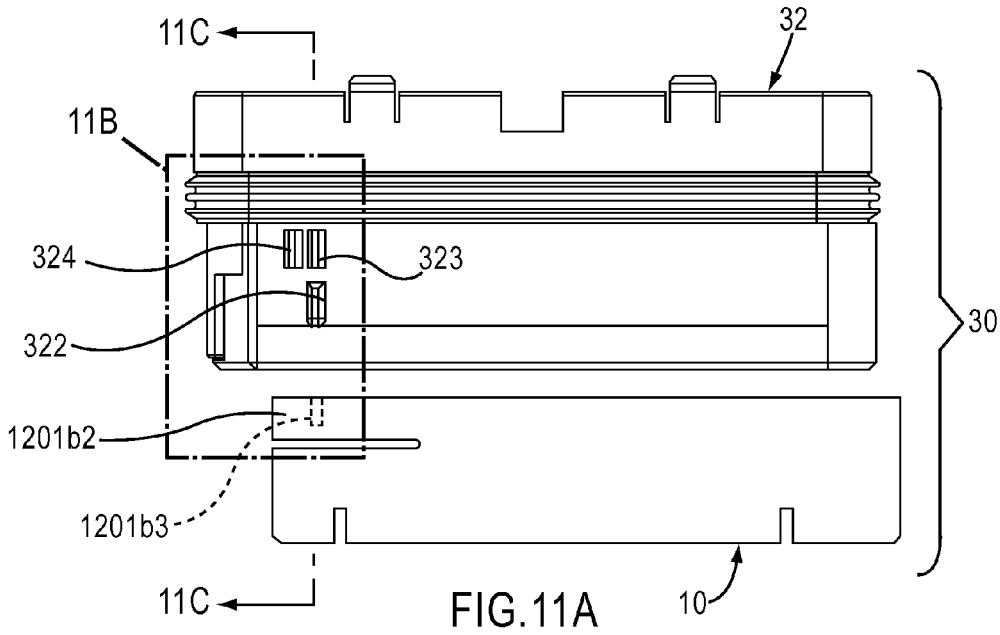
FIG. 11A is a top plan view of the terminal position assurance device and the terminal connector with the terminal position assurance device being in an initial alignment position with the terminal connector.
Figure 11B:
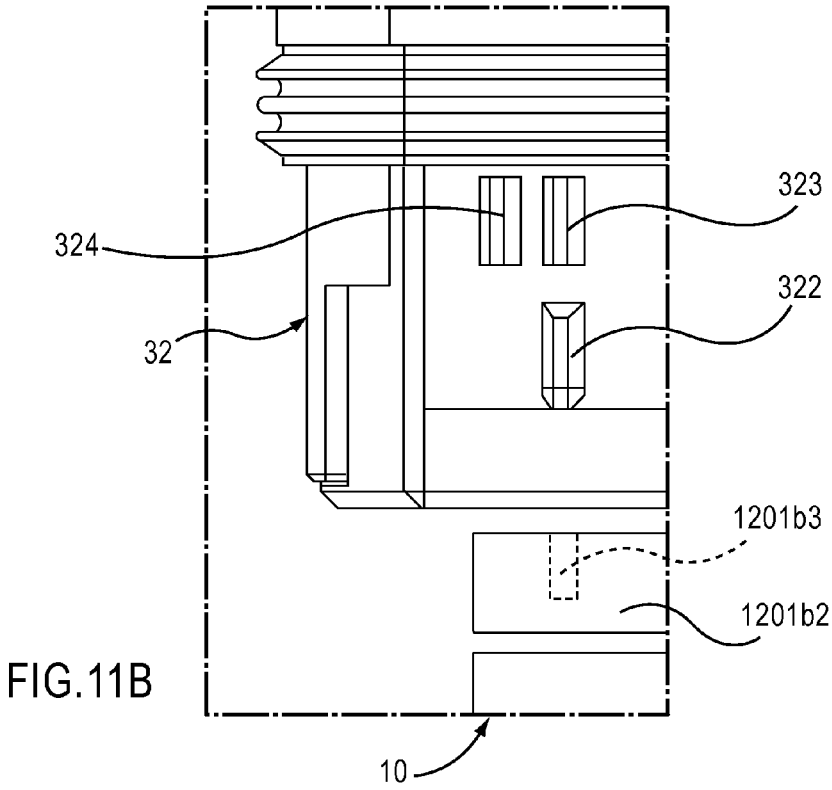
FIG. 11B is an enlarged partial top plan view taken from FIG. 11A.
Figure 11C:
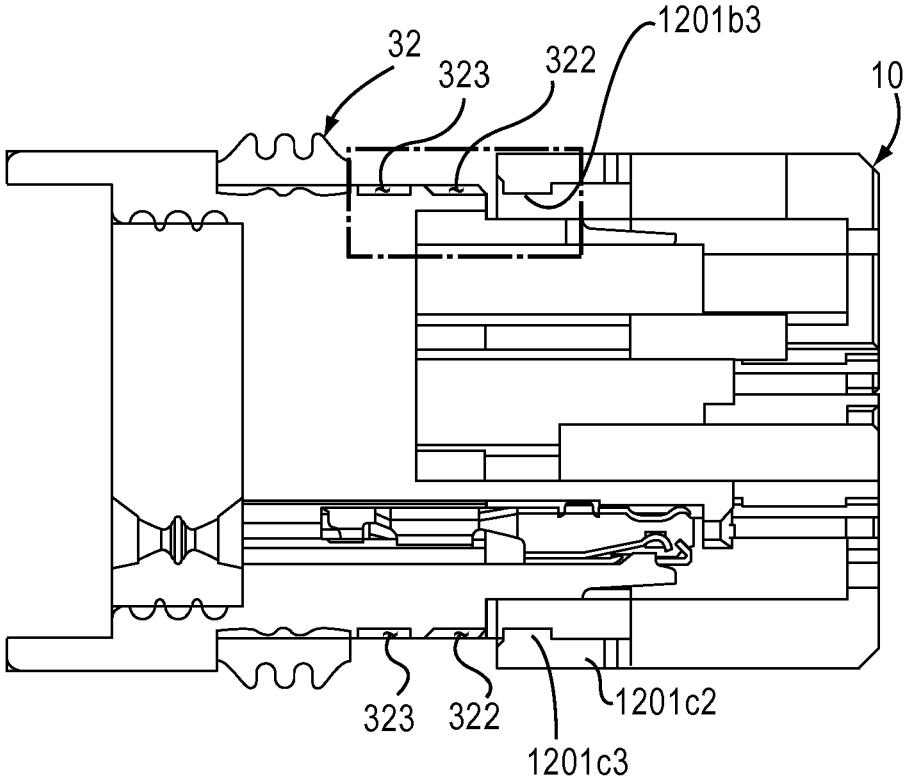
FIG. 11C is a side elevational view shown in cross-section taken along line 11C-11C in FIG. 11A.
Figure 11D:
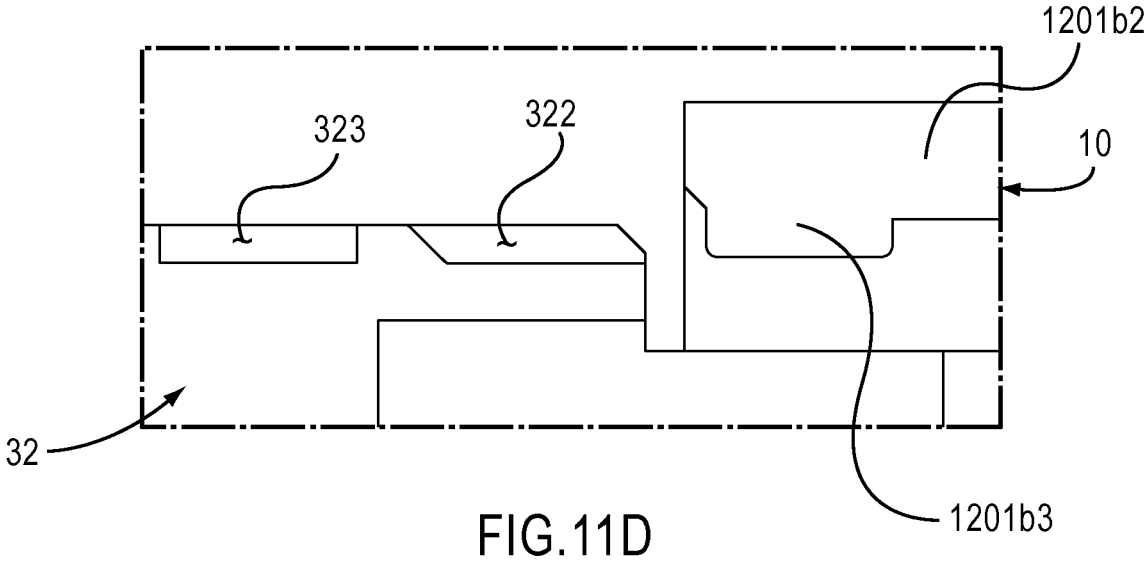
FIG. 11D is an enlarged partial side elevational view taken from FIG. 11C.
Figure 11E:
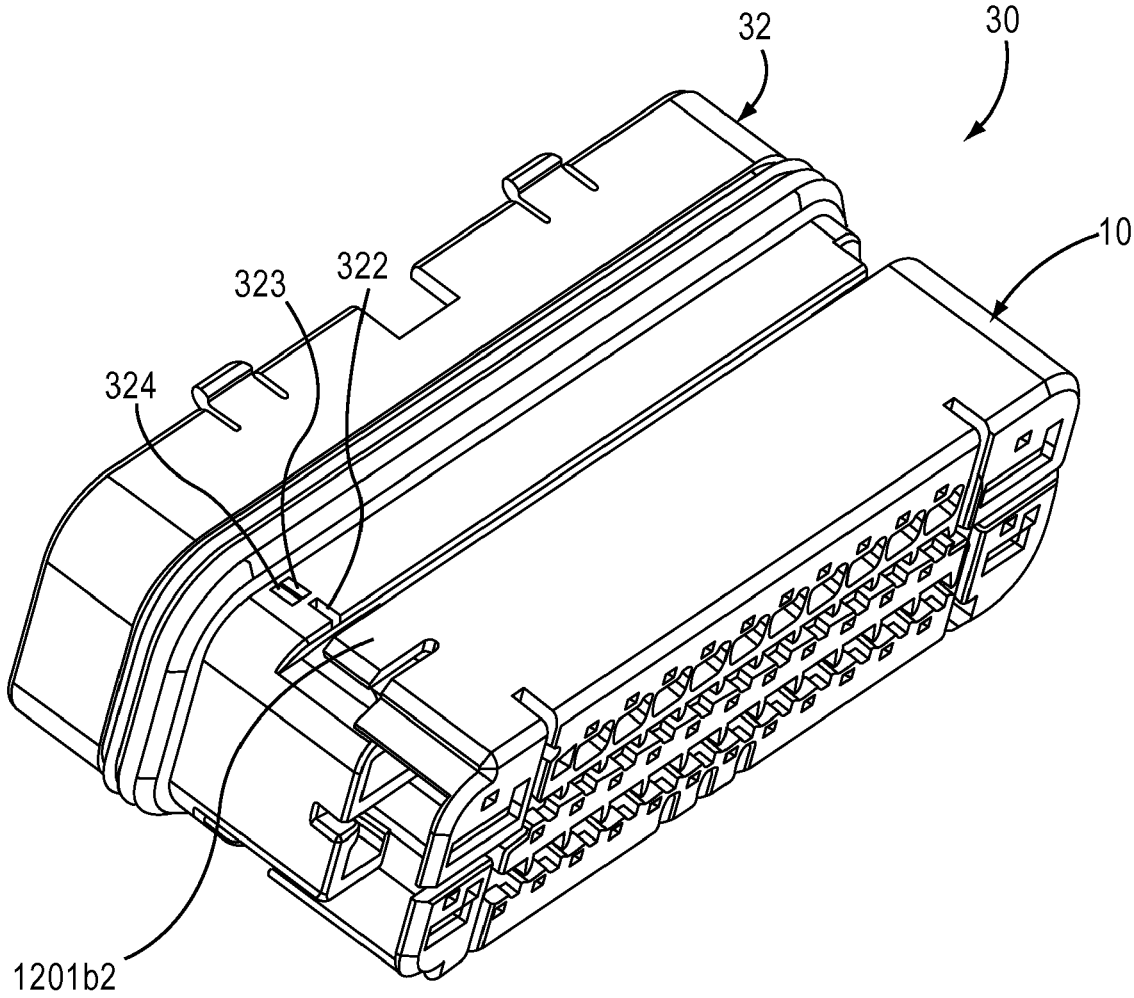
FIG. 11E is a perspective view of the terminal position assurance device and the terminal connector in the initial alignment position.

In the initial alignment position (FIGS. 11A-11E), respective ones of the locking tabs 1201*b*3 and 1201*c*3 are positioned to align with respective ones of the guide slots 322. Also, as best shown in FIGS. 9A and 10A, respective ones of the plurality of matrix tubes 1401 are positioned to align with respective ones of the plurality of female terminal-receiving channel members 361.

Figure 12A:
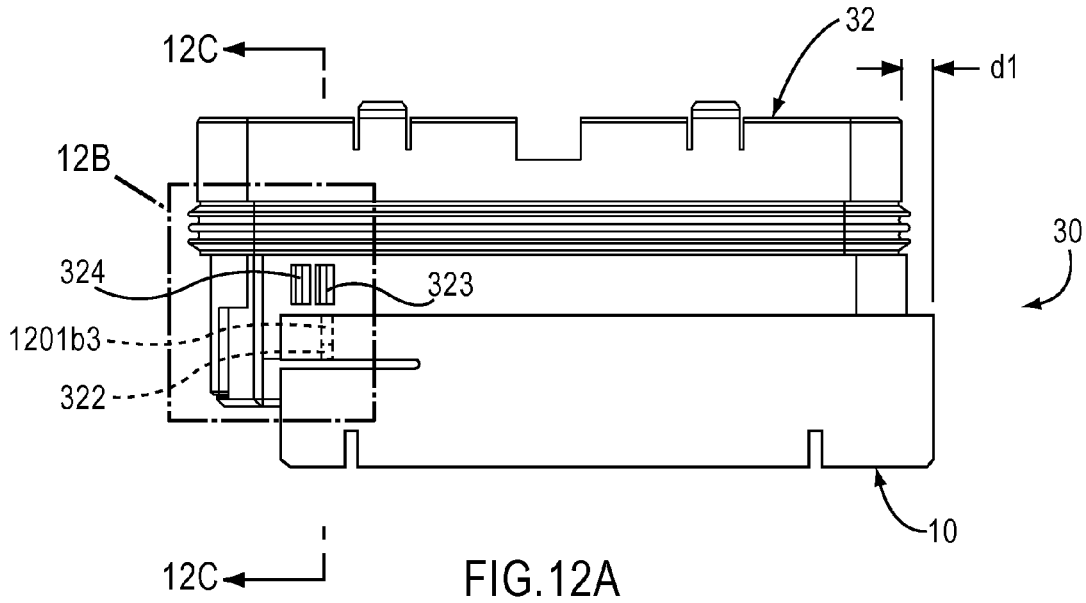
FIG. 12A is a top plan view of the terminal position assurance device and the terminal connector with the terminal position assurance device being in a pre-lock position.
Figure 12B:
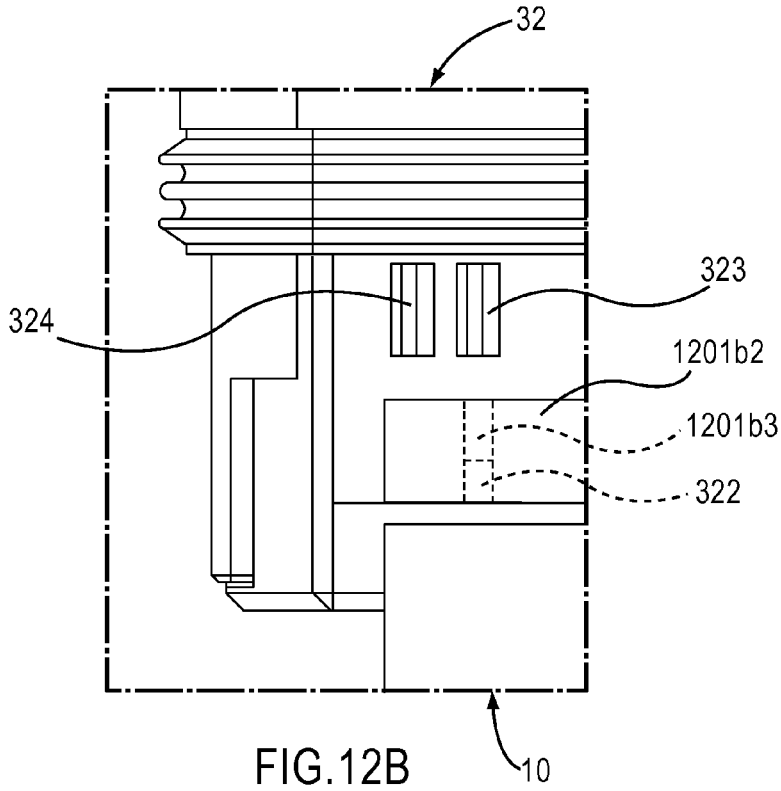
FIG. 12B is an enlarged partial top plan view taken from FIG. 12A.
Figure 12C:
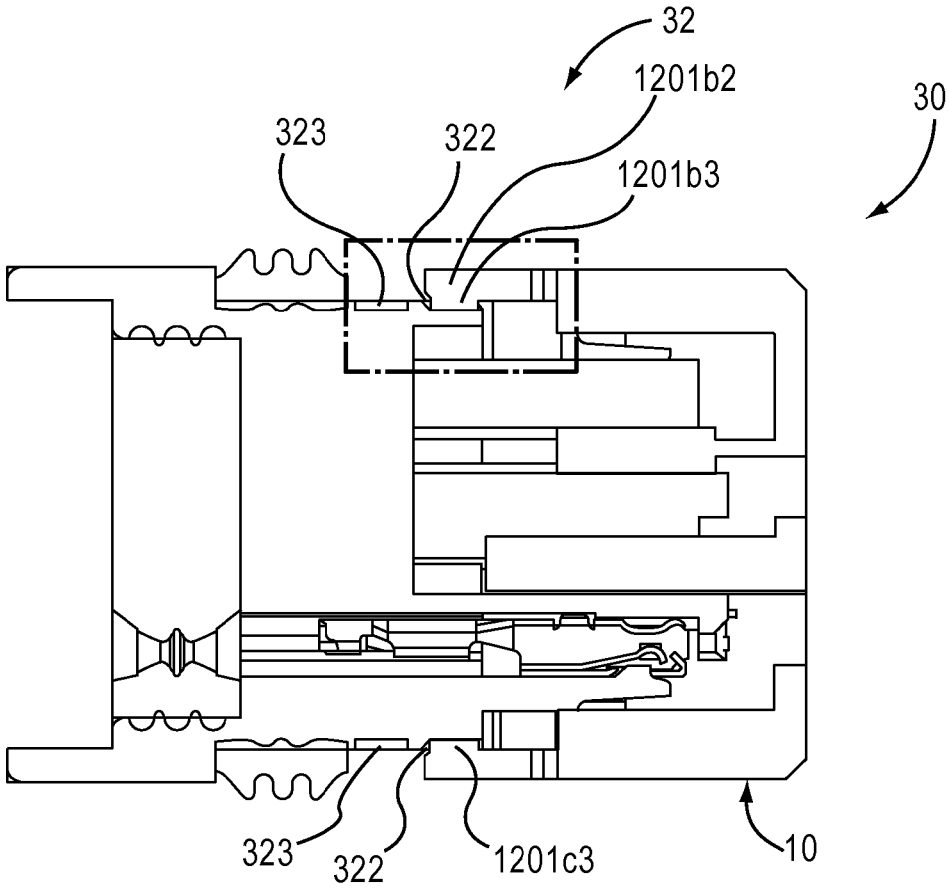
FIG. 12C is a side elevational view shown in cross-section taken along line 12C-12C in FIG. 12A.
Figure 12D:
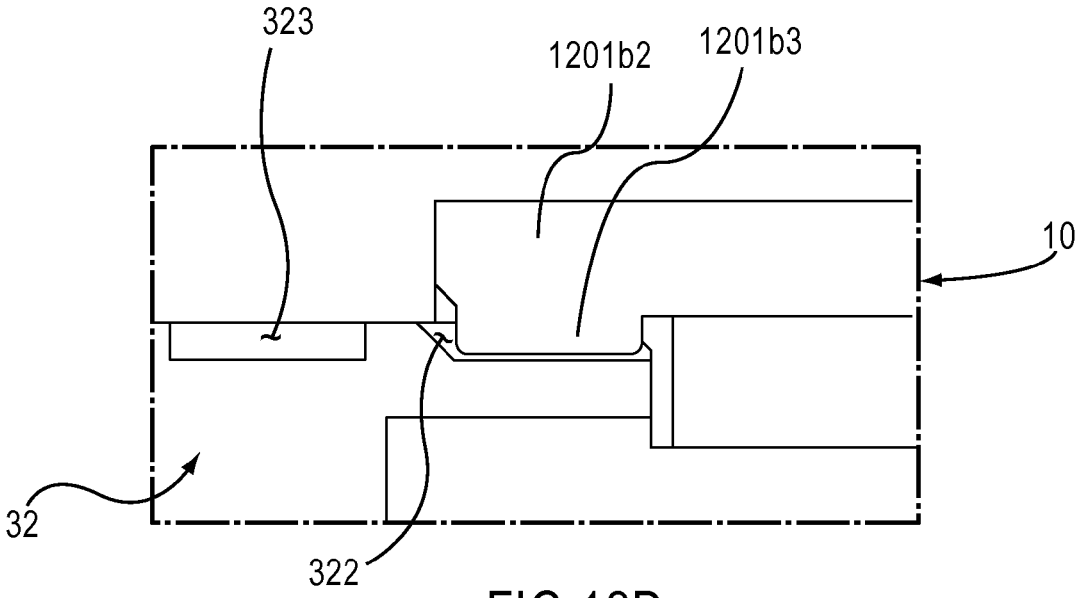
FIG. 12D is an enlarged partial side elevational view taken from FIG. 12C.
Figure 13A:
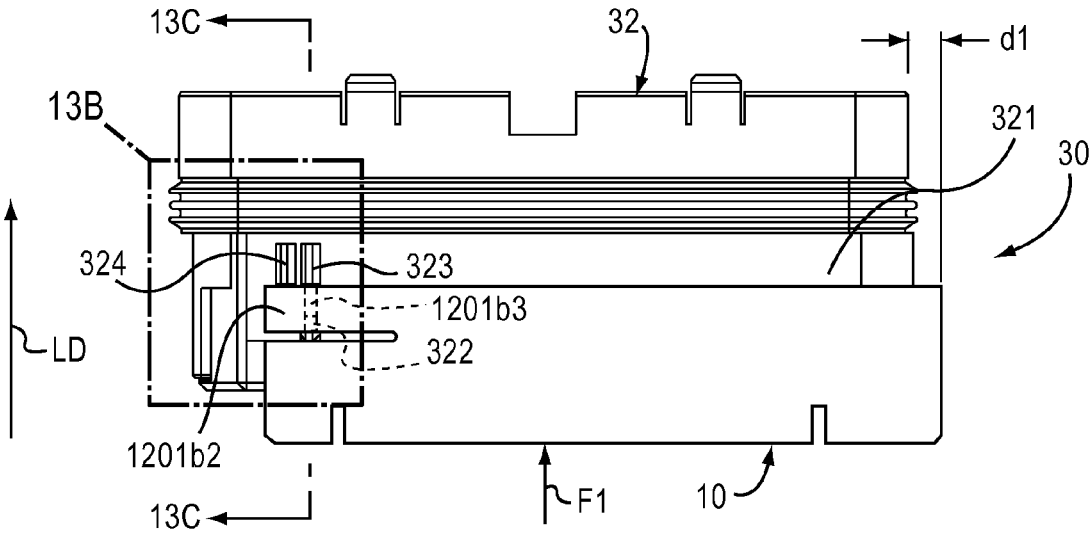
FIG. 13A is a top plan view of the terminal position assurance device and the terminal connector with the terminal position assurance device transitioning from the pre-lock position to an initial lock position.
Figure 13B:
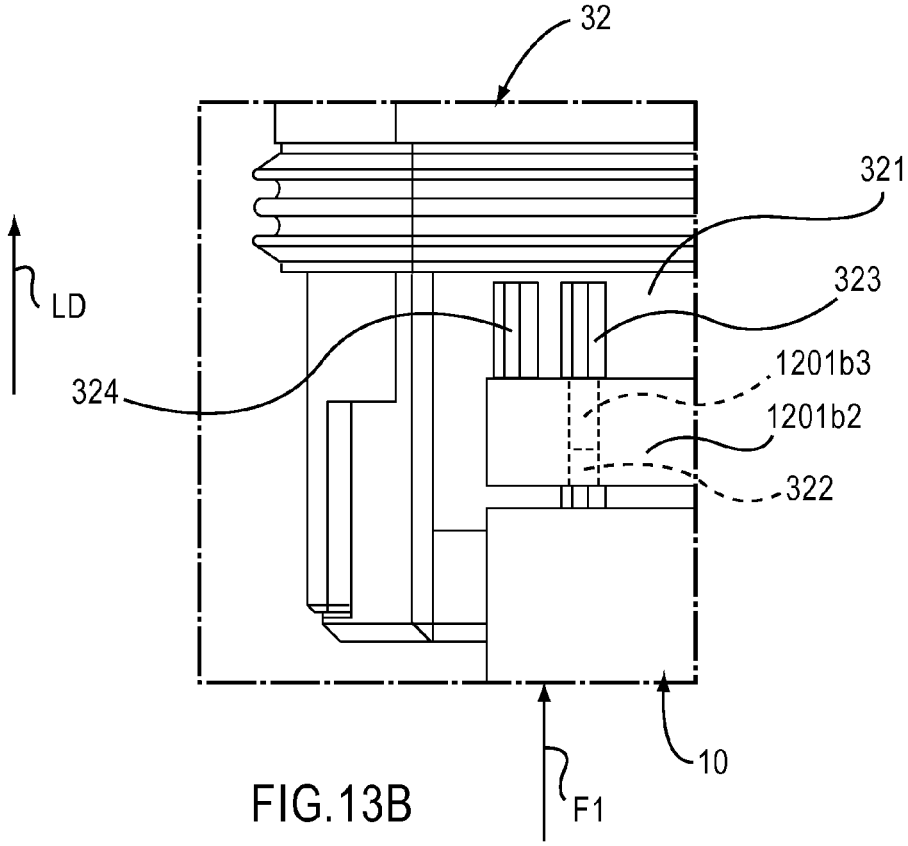
FIG. 13B is an enlarged partial top plan view taken from FIG. 13A.
Figure 13C:
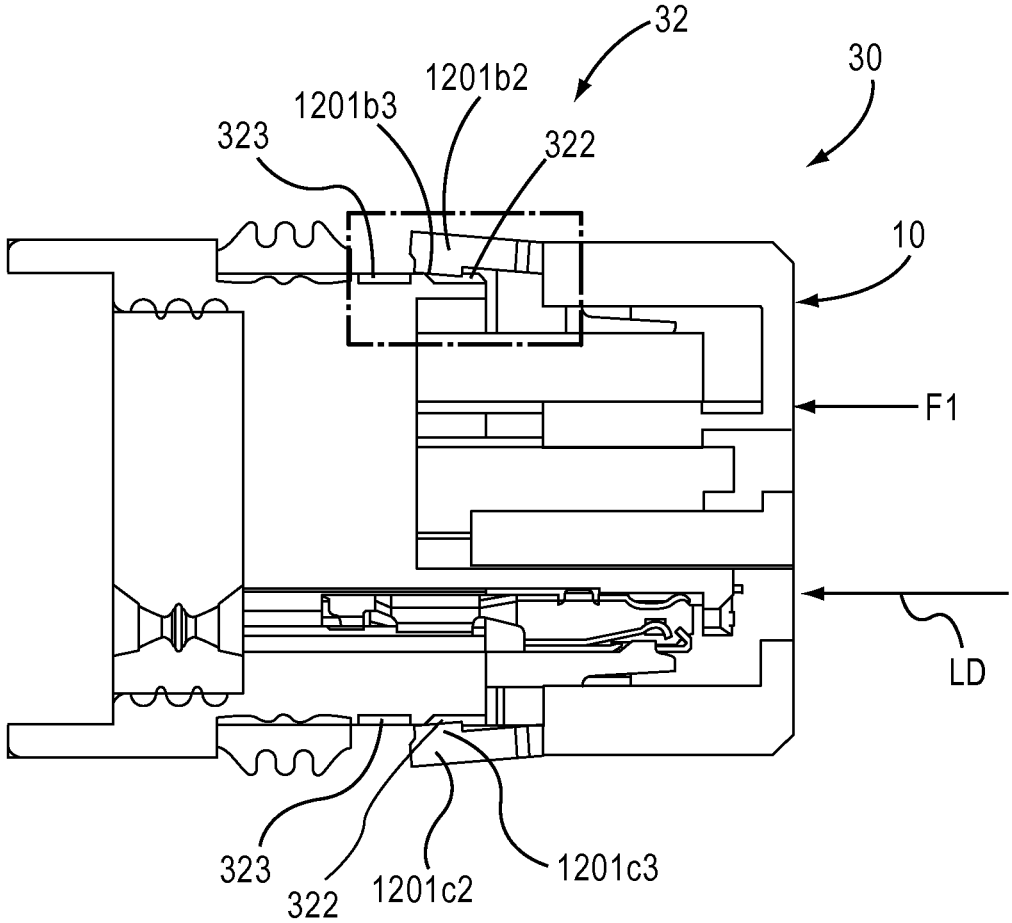
FIG. 13C is a side elevational view shown in cross-section taken along line 12C-12C in FIG. 12A.
Figure 13D:
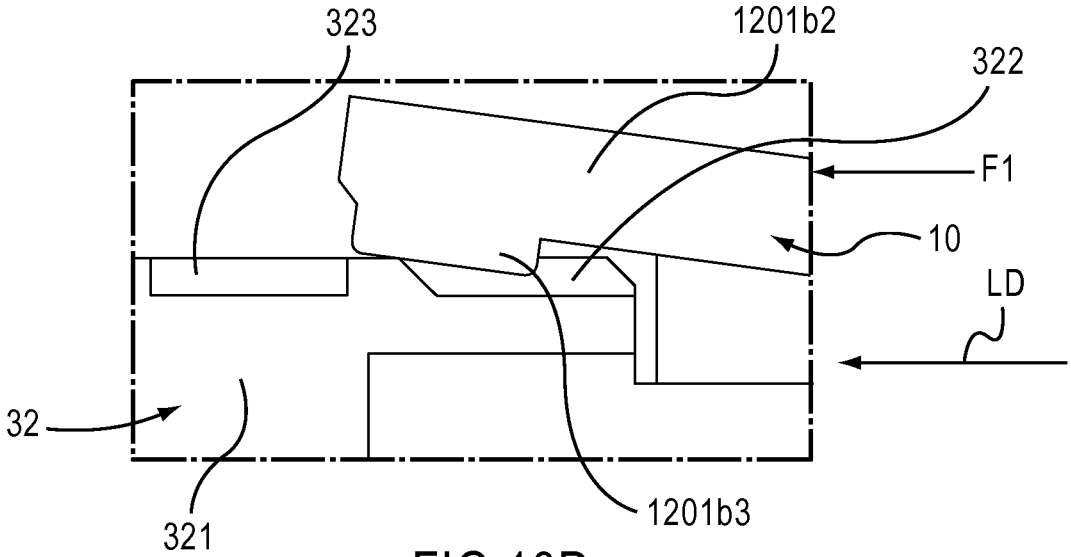
FIG. 13D is an enlarged partial side elevational view taken from FIG. 13C.
Figure 13E:
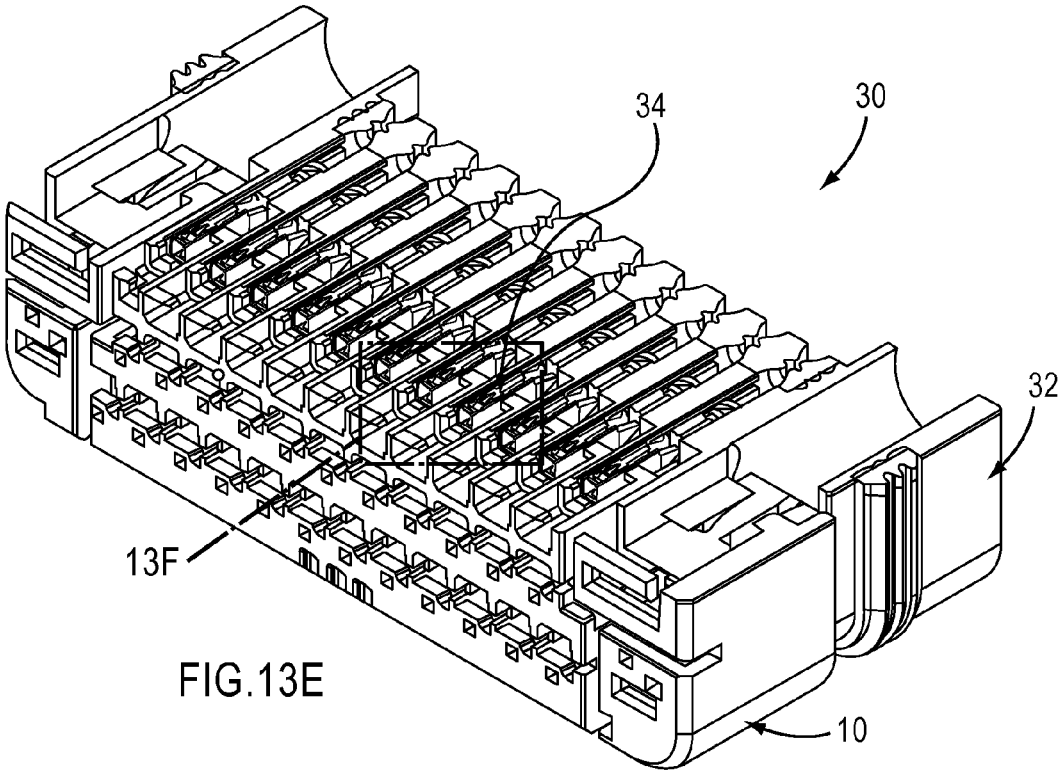
FIG. 13E is a perspective view of the terminal position assurance device and the terminal connector transitioning from the pre-lock position to the initial lock position.
Figure 13F:
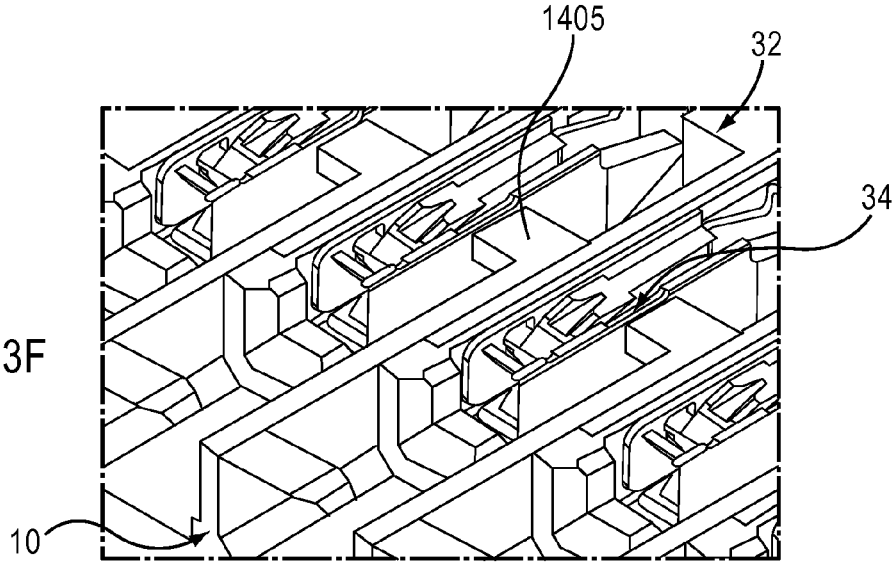
FIG. 13F is an enlarged partial perspective view taken from FIG. 13E.

In the pre-lock position (FIGS. 12A-12F), respective ones of the locking tabs 1201*b*3 and 1201*c*3 are slidably received in respective ones of the guide slots 322. Also, a forward portion 321*a* (FIG. 9A disposed forward of the dashed line DL) of the insertion part 321 is received in the U-shaped recess portion 1206*a* (FIG. 9A) of the housing cavity 1206. In FIG. 12F, respective ones of the plurality of female terminal-receiving channel members 361 are partially received in respective ones of the plurality of matrix tubes 1401 and respective ones of the terminal retainer tabs 1405 positioned juxtaposed to respective ones of the U-shaped front portions 341 of the plurality of female terminals 34.

FIGS. 13A-13D illustrate the terminal position assurance device 10 moving relative to the terminal connector 32 from the pre-lock position (FIGS. 12A-12F) to the initial lock position (FIGS. 14A-14F). In FIGS. 13A-13D, a first force, depicted by arrow F1, is applied in the longitudinal direction LD to cause respective ones of the free end latch portions 1201*b*2 and 1201*c*2 to move from the normal state to the flexed state while respective ones of the locking tabs 1201*b*3 and 1201*c*3 slide along the insertion part 321 in the longitudinal direction LD and to advance the plurality of matrix tubes 1401 onto the plurality of female terminal-receiving channel members 361 (see FIGS. 12F, 13F and 14F).

Figure 14A:
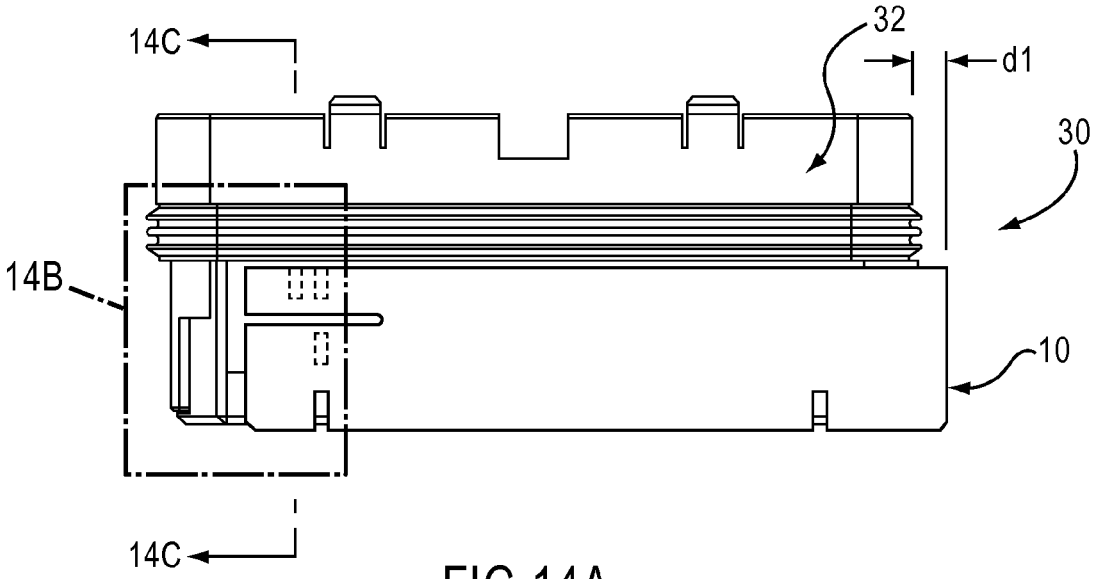
FIG. 14A is a top plan view of the terminal position assurance device and the terminal connector with the terminal position assurance device being in the initial lock position.
Figure 14B:
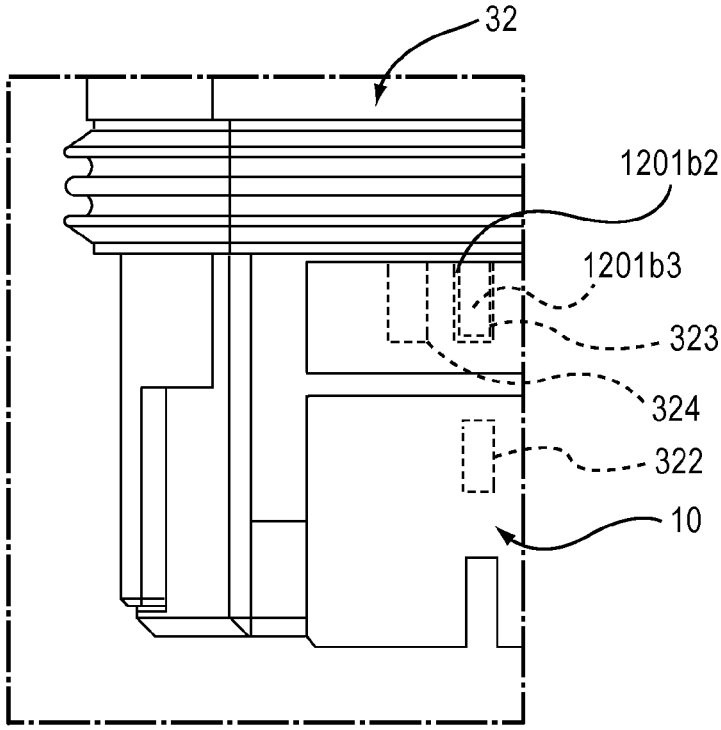
FIG. 14B is an enlarged partial top plan view taken from FIG. 14A.
Figure 14C:
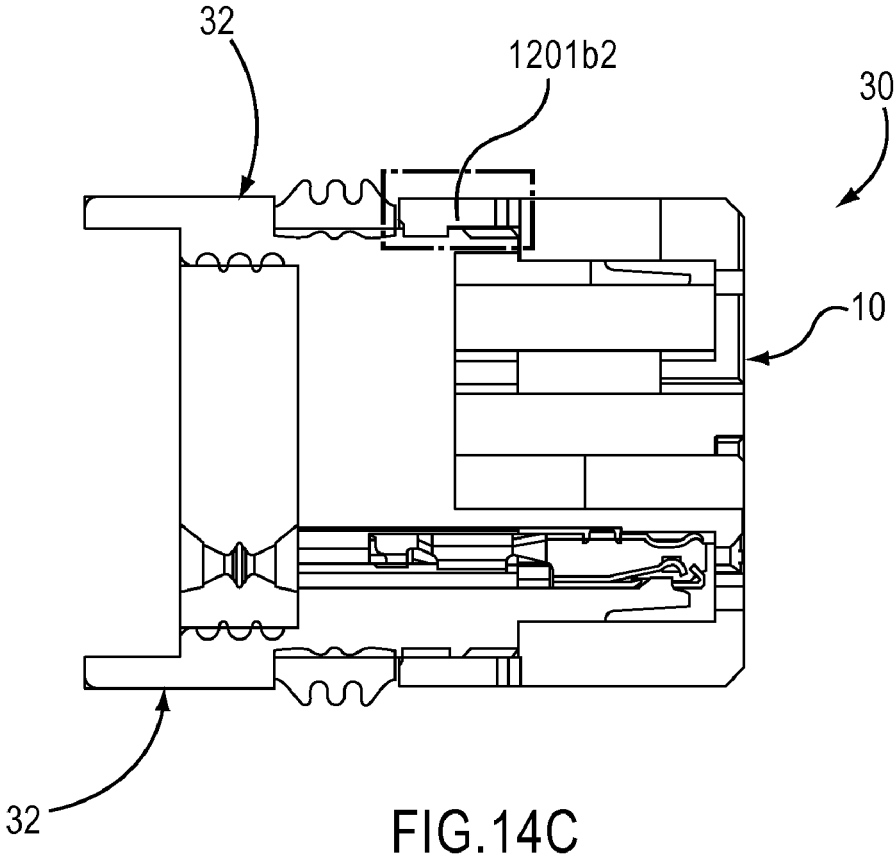
FIG. 14C is a side elevational view shown in cross-section taken along line 14C-14C in FIG. 14A.
Figure 14D:
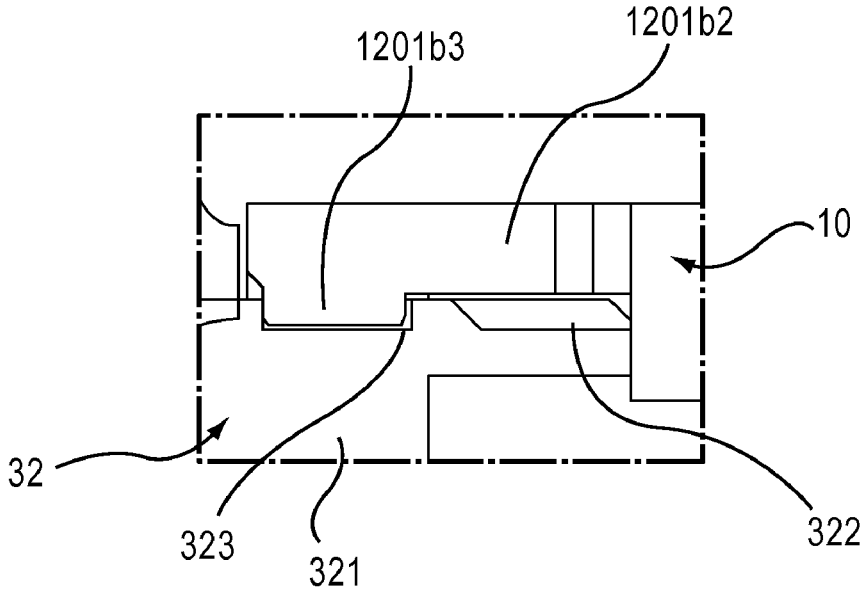
FIG. 14D is an enlarged partial side elevational view taken from FIG. 14C.
Figure 14E:
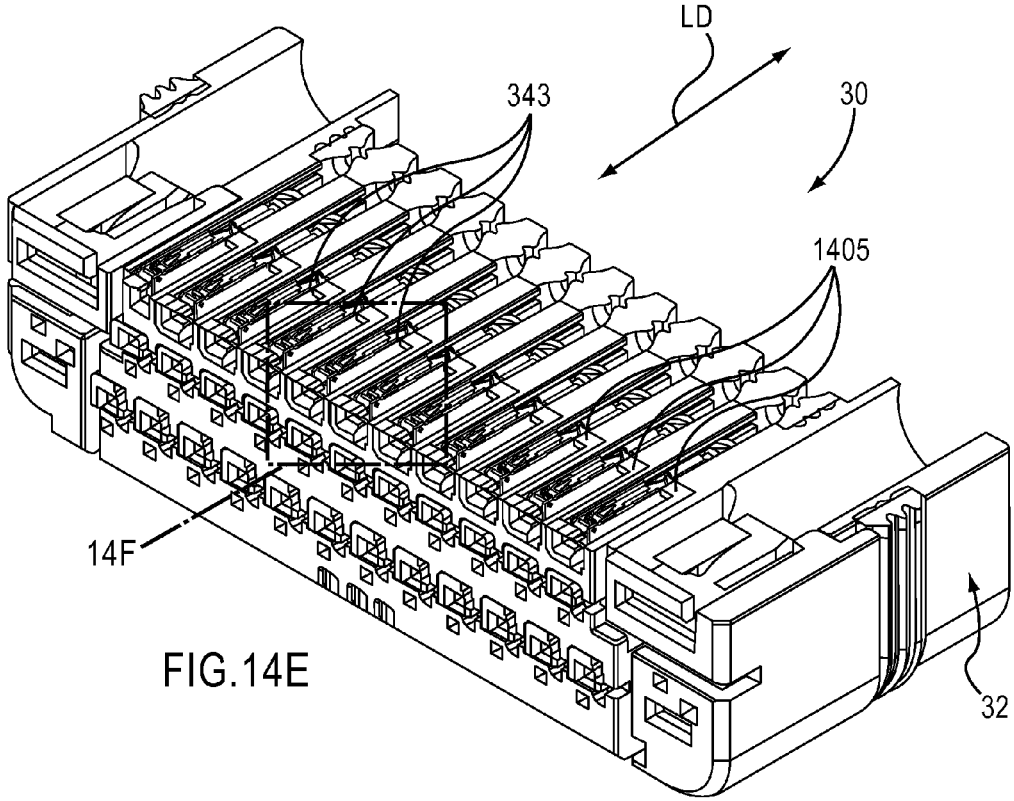
FIG. 14E is a perspective view of the terminal position assurance device and the terminal connector in the initial lock position.
Figure 14F:
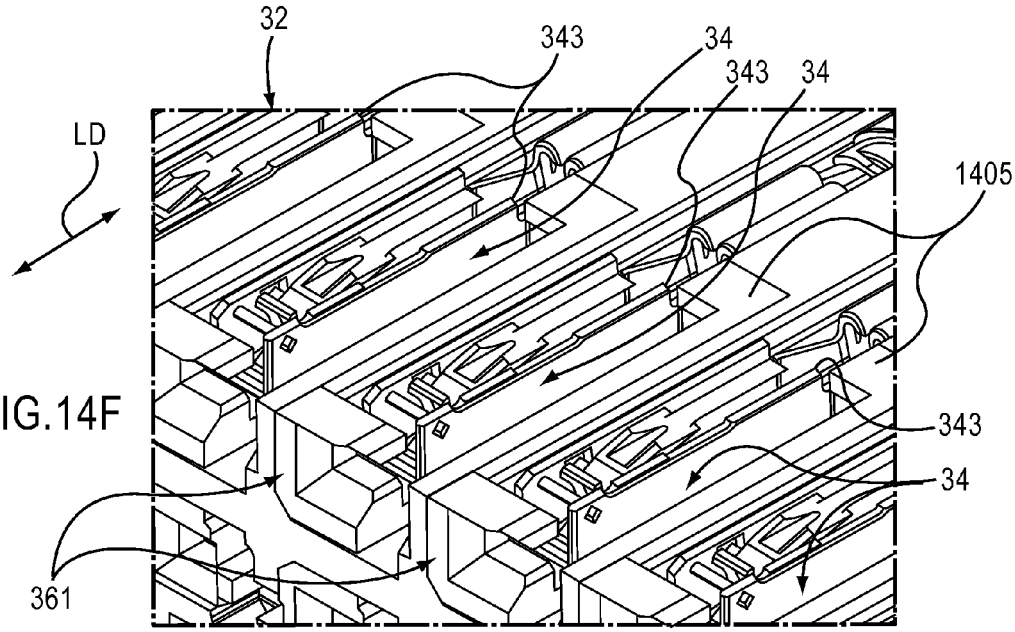
FIG. 14F is an enlarged partial perspective view taken from FIG. 14E.
Figure 15A:
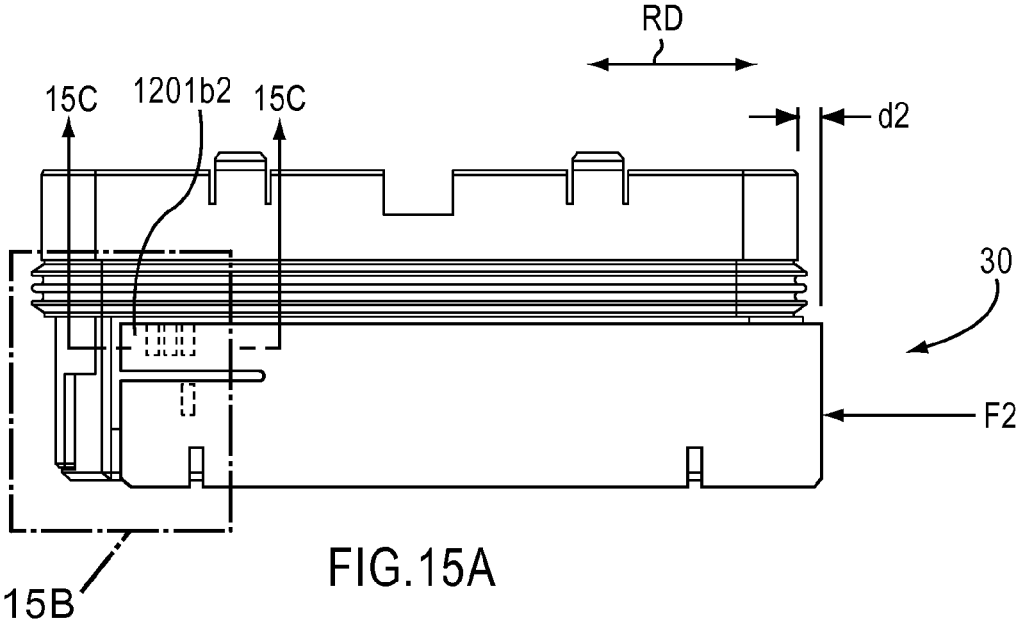
FIG. 15A is a top plan view of the terminal position assurance device and the terminal connector with the terminal position assurance device transitioning from the initial lock position to a final lock position.
Figure 15B:
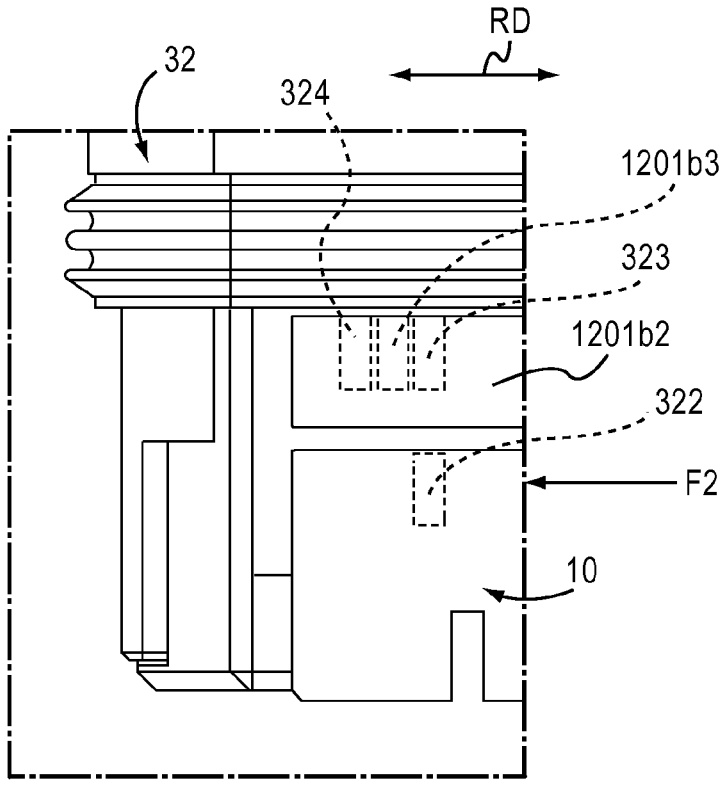
FIG. 15B is an enlarged partial top plan view taken from FIG. 15A.
Figure 15C:
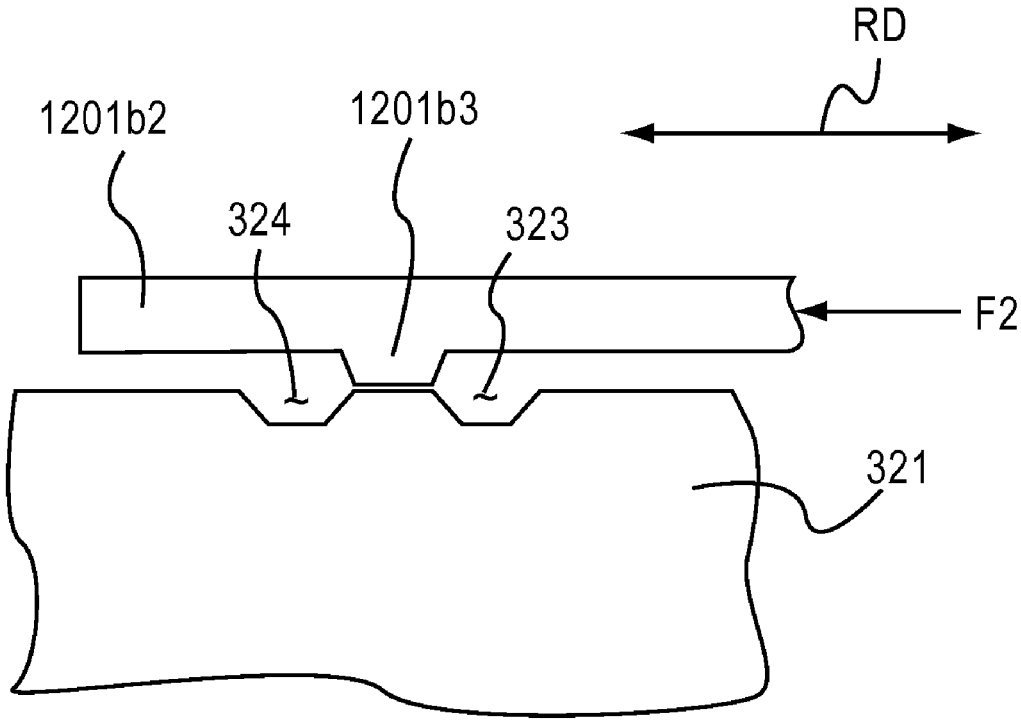
FIG. 15C is a partial cross-sectional view taken along line 15C-15C in FIG. 15A.
Figure 15D:
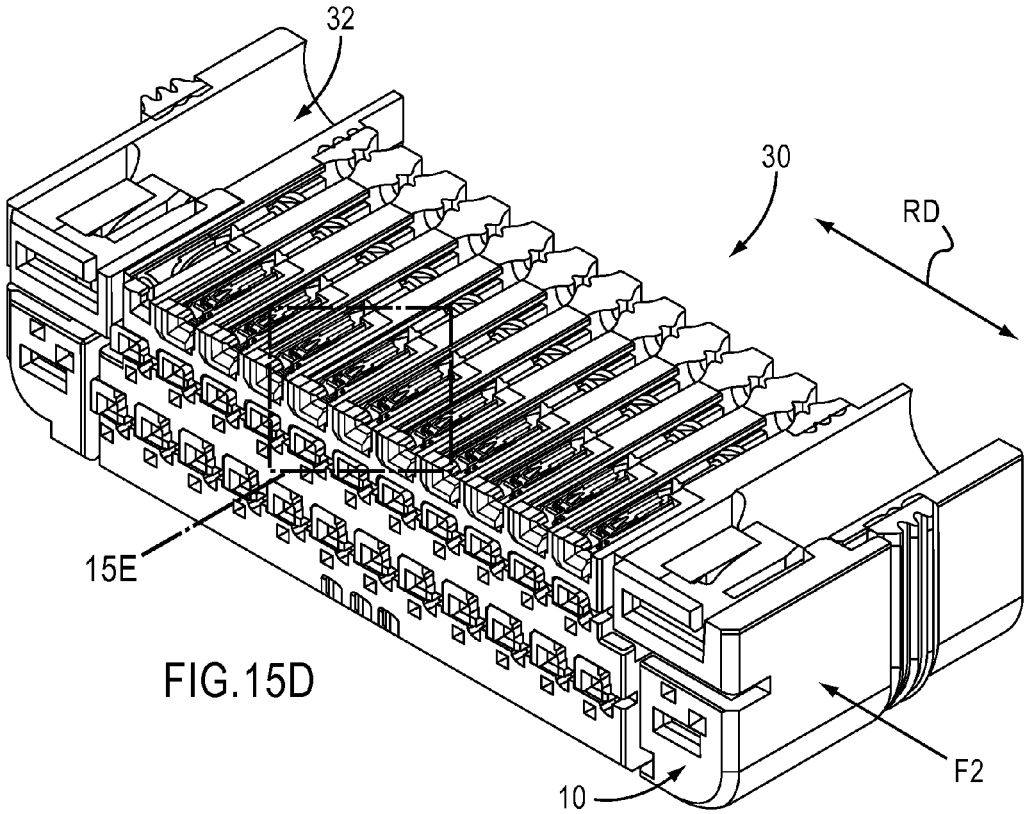
FIG. 15D is a perspective view in planar cross-section of the terminal position assurance device and the terminal connector transitioning from the initial lock position to the final lock position.
Figure 15E:
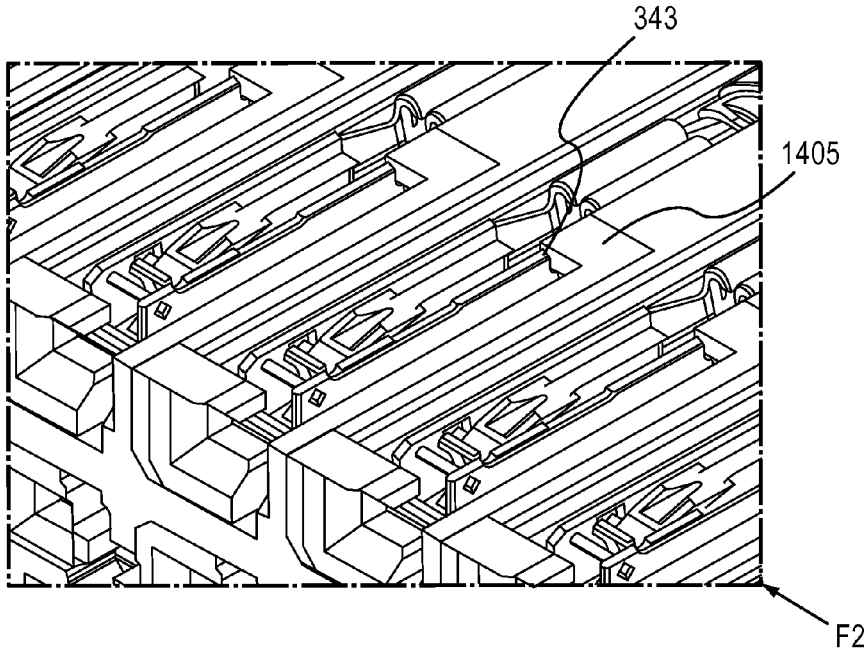
FIG. 15E is an enlarged partial perspective view in cross-section taken from FIG. 15D.
Figure 16A:
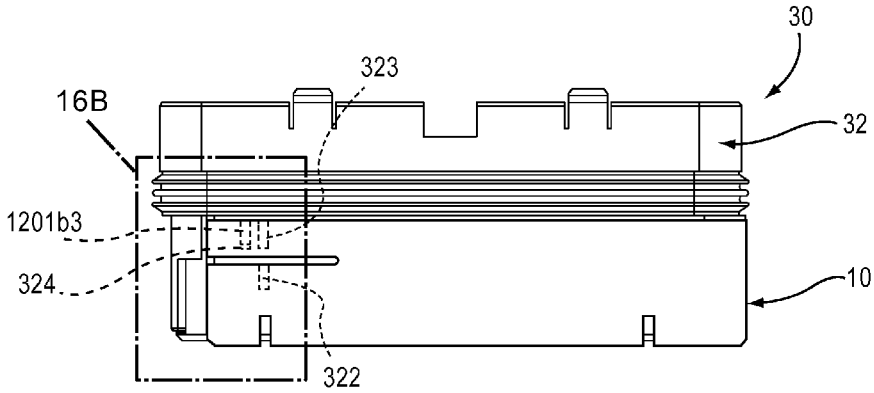
FIG. 16A is a top plan view of the terminal position assurance device and the terminal connector with the terminal position assurance device in the final lock position.
Figure 16B:
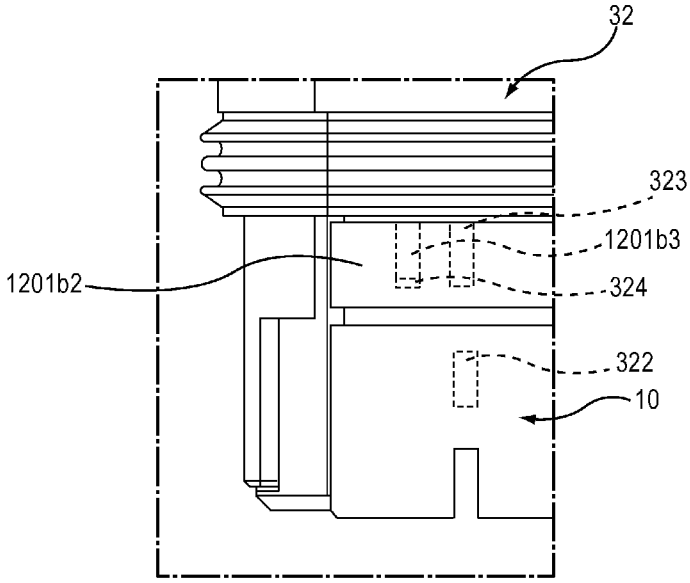
FIG. 16B is an enlarged partial top plan view taken from FIG. 16A.
Figure 16C:
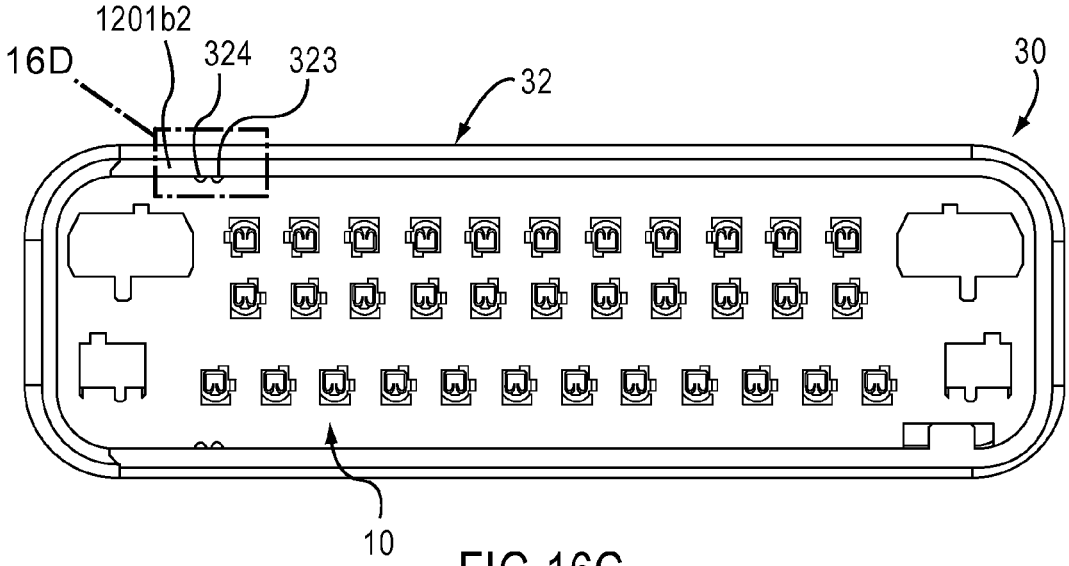
FIG. 16C is a front elevational view of the terminal position assurance device and the terminal connector with the terminal position assurance device in the final lock position.
Figure 16D:
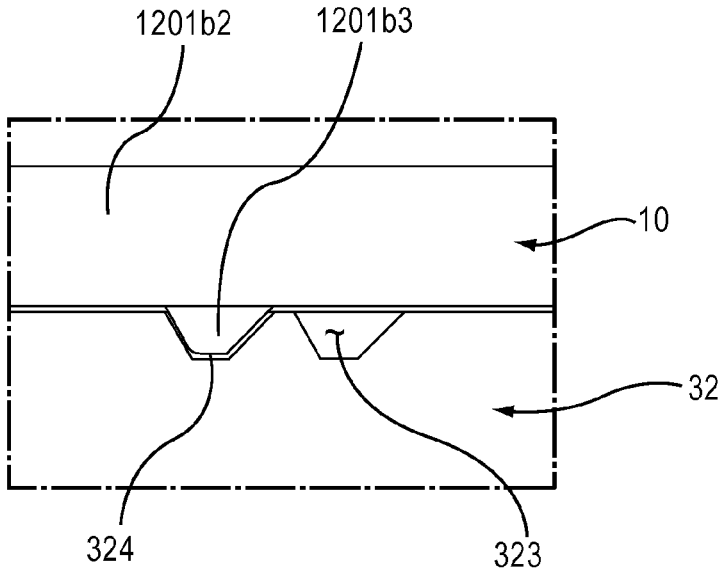
FIG. 16D is an enlarged partial front elevational view taken from FIG. 16C.
Figure 16E:
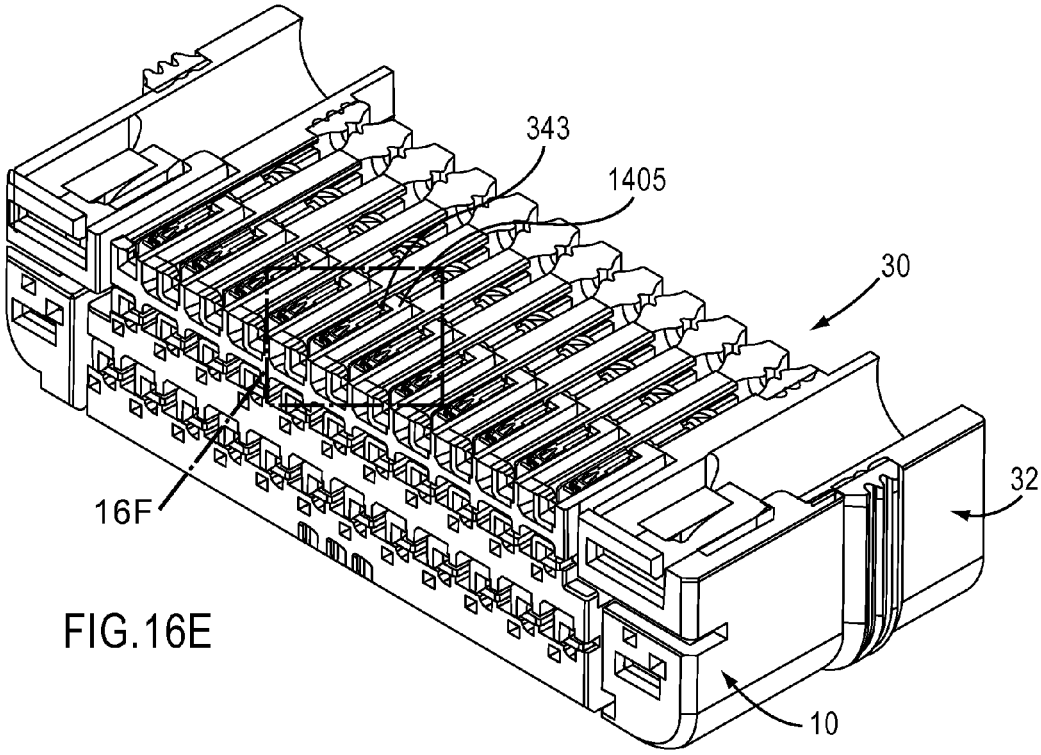
FIG. 16E is a perspective view in planar cross-section of the terminal position assurance device and the terminal connector in the final lock position.
Figure 16F:
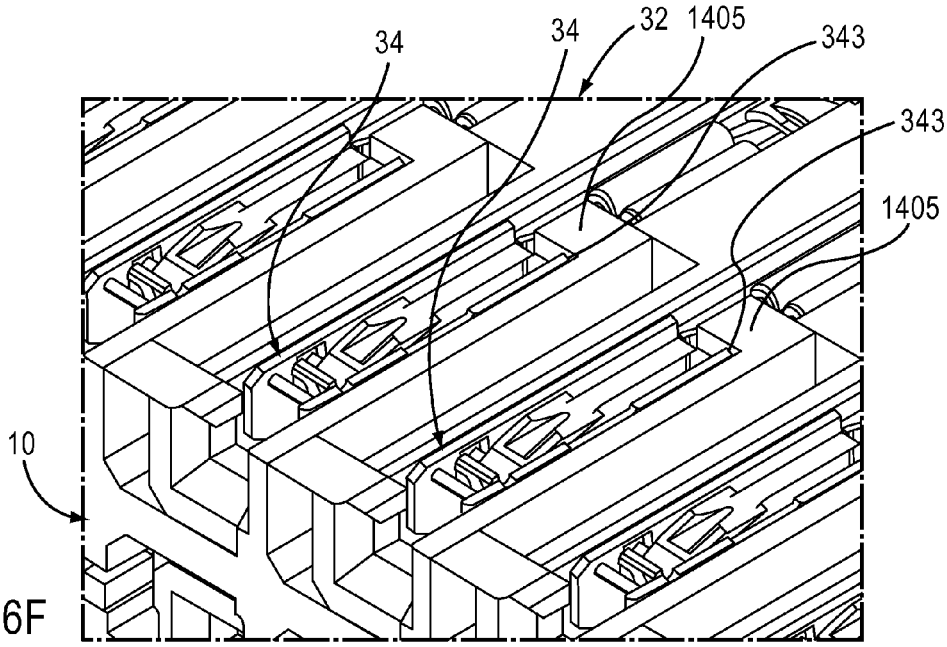
FIG. 16F is an enlarged partial perspective view in planar cross-section taken from FIG. 16E.

FIGS. 14A-14F illustrate the terminal position assurance device 10 in the initial lock position. In the initial lock position, respective ones of the locking tabs 1201*b*3 and 1201*c*3 are received in the respective ones of the pair of first indentations 323, 323 in a close-fitting relationship. Simultaneously therewith, respective ones of the terminal retainer tabs 1405 are rearwardly offset relative to one of the pair of stop walls 343 in the longitudinal direction LD as best shown in FIGS. 14E and 14F.

From the initial lock position (FIGS. 14A-14F) to the final lock position (FIGS. 16A-16F), a second force as arrow F2 as shown in FIGS. 15A-15E is applied in the lateral direction LD to cause respective ones of the free end latch portions 1201*b*2 (1201*c*2 is not illustrated) to move from the normal state to the flexed state while respective ones of the locking tabs 1201*b*3 (1201*c*3 is not illustrated) slide along the insertion part 321 in the lateral direction LD and while the respective ones of the terminal retainer tabs 1405 move in the lateral direction LD behind one of the respective pairs of stop walls 343; and FIGS. 16A-16F illustrate the terminal position assurance device 10 in the initial lock position. In the final lock position, respective ones of the locking tabs 1201*b*3 and 1201*c*3 are received in respective ones of the second indentations 324 in a close-fitting relationship. The free end latch portions 1201*b*2 and 1201*c*2 return to the normal state. Also, respective ones of the terminal retainer tabs 1405 are disposed in a stationary position behind at least one of the respective pairs of stop walls 343. In this manner, the female terminals 34 are virtually locked into position.

One of ordinary skill in the art would appreciate that the terminal position assurance device of the present invention assures, during its connection to the female terminal connector, that all of the female terminals are properly inserted into the female terminal connector. If one of the female terminals is not fully inserted into the terminal connector, the terminal retainer tab will prevent the terminal position assurance device to move from the initial lock position to the final lock position. Thus, the terminal position assurance device moves from the initial lock position to the final lock position only if all of the female terminals are fully and properly inserted into the female terminal housing. In this way, the terminal position assurance device mechanically "detects" partial, and thus, improper, insertion of one or more the female terminals into the female terminal connector by virtue of the terminal position assurance device not being able to move to the final lock position from the initial lock position.

One of ordinary skill in the art would appreciate that the terminal position assurance device can lock onto the female terminal connector in two separate locking positions such as from the initial lock position where the terminal position assurance device is releasably connected to the female terminal connector without any detection capability to determine whether the female terminals are properly inserted into the female connector and to the final locking position where assurance is operative to determine if the female terminals are properly inserted into the female terminal connector.

Further, one skilled in the art would appreciate the terminal position assurance device moves in a first direction from a pre-lock position to the initial lock position then moves from the initial lock position to the final lock position in a second direction which is perpendicular to the first direction.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A terminal position assurance device, comprising:

a housing extending along and about a longitudinal axis defining a longitudinal direction, a lateral axis defining a lateral direction and a transverse axis defining a transverse direction, the longitudinal axis, the lateral axis and the transverse axis perpendicularly intersecting one another to form a Cartesian coordinate system, the housing having a U-shaped member, a top wall, a bottom wall extending parallel to the top wall and a pair of side walls disposed apart from and extending generally parallel to one another and interconnecting the top and bottom walls to form a generally parallelepiped configuration to define a housing cavity extending in the longitudinal direction, the U-shaped member having a base extending in the transverse direction and a pair of arms extending generally parallel to each other in the lateral direction and generally perpendicularly to the base member with each arm having a fixed arm portion and a free end latch portion integrally connected to the fixed arm portion, the base integrally formed with one of the pair of side walls and respective ones of the fixed arm portions integrally formed with respective ones of the top and bottom walls, respective ones of the free end latch portions and the top and bottom walls being separated from one other by a slot formed therebetween; and a matrix body disposed in the housing cavity and having a plurality of matrix tubes with each matrix tube defining a matrix passageway therethrough in the longitudinal direction, the U-shaped member disposed forward of the matrix body in the longitudinal direction to form a U-shaped recess portion of the housing cavity disposed forwardly of the matrix body wherein, each one of the free end latch portions has a locking tab extending in the longitudinal direction and projecting into the U-shaped recess portion.

2. A terminal position assurance device according to claim 1, wherein each one of the free end latch portions extends in the lateral and longitudinal directions and parallel to one another in a normal state.

3. A terminal position assurance device according to claim 2, wherein each one of the free end latch portions is operative to pivot generally transversely away from the U-shaped recess portion in a flexed state and is resiliently biased to the normal state.

4. A terminal position assurance device according to claim 1, wherein the plurality of matrix tubes is constructed from a series of horizontal wall sections and a series of vertical wall sections, the horizontal wall sections are disposed apart from one another in the transverse direction and extend in the longitudinal and lateral directions and the series of vertical wall sections interconnect the horizontal wall sections, are disposed apart from one another in the lateral direction and extend in the longitudinal and transverse directions.

5. A terminal position assurance device according to claim 4, wherein each one of the series of vertical wall sections includes a terminal retainer tab projecting laterally into respective ones of the matrix passageways.

6. A terminal position assurance device according to claim 5, wherein each one of the terminal retainer tabs is disposed rearwardly in the matrix body relative to the U-shaped recess portion.

7. A terminal position assurance device according to claim 1, further comprising a guide rail extending in the longitudinal direction and disposed in at least the U-shaped recess portion of the housing cavity.

8. A terminal position assurance device according to claim 1, wherein respective ones of the locking tabs taper inwardly from respective ones of the free end latch portions into the U-shaped recess portion.

9. A terminal position assurance device according to claim 8, wherein respective ones of the locking tabs are disposed forwardly in the longitudinal direction of the respective ones of the free end latch portions and extend partially rearwardly along the respective ones of the free end latch portions.

10. A terminal position assurance device, comprising:

a housing extending along and about a longitudinal axis defining a longitudinal direction, a lateral axis defining a lateral direction and a transverse axis defining a transverse direction, the longitudinal axis, the lateral axis and the transverse axis perpendicularly intersecting one another to form a Cartesian coordinate system, the housing having a top wall, a bottom wall extending parallel to the top wall and a pair of side walls disposed apart from and extending generally parallel to one another and interconnecting the top and bottom walls to form a generally parallelepiped configuration to define a housing cavity extending in the longitudinal direction; and a matrix body disposed in the housing cavity and having a plurality of matrix tubes with each matrix tube defining a matrix passageway therethrough in the longitudinal direction, wherein the plurality of matrix tubes is constructed from a series of horizontal wall sections and a series of vertical wall sections, the horizontal wall sections are disposed apart from one another in the transverse direction and extend in the longitudinal and lateral directions and the series of vertical wall sections interconnect the horizontal wall sections, are disposed apart from one another in the lateral direction and extend in the longitudinal and transverse directions and wherein each one of the series of vertical wall sections includes a terminal retainer tab projecting laterally into a respective one of the plurality of matrix passageways.

11. A terminal position assurance device according to claim 10, wherein each one of the terminal retainer tabs is disposed rearwardly in the matrix body.

12. A terminal position assurance device according to claim 10, wherein the housing has a U-shaped member having a base extending in the transverse direction and a pair of arms extending generally parallel to each other in the lateral direction and generally perpendicularly to the base member with each arm having a fixed arm portion and a free end latch portion integrally connected to the fixed arm portion, the base is integrally formed with one of the pair of side walls and respective ones of the fixed arm portions integrally formed with respective ones of the top and bottom walls, respective ones of the free end latch portions and the top and bottom walls being separated from one other by a slot formed therebetween.

13. A terminal position assurance device according to claim 12, wherein each one of the free end latch portions has a locking tab extending in the longitudinal direction and projecting into the U-shaped recess portion.

14. A terminal position assurance device according to claim 13, wherein respective ones of the locking tabs are disposed forwardly in the longitudinal direction of the respective ones of the free end latch portions and extend partially rearwardly along the respective ones of the free end latch portions.

15. A terminal position assurance device according to claim 14, wherein respective ones of the locking tabs taper inwardly from respective ones of the free end latch portions into the U-shaped recess.

16. A terminal position assurance device according to claim 12, wherein each one of the free end latch portions extends in the lateral and longitudinal directions and parallel to one another in a normal state.

17. A terminal position assurance device according to claim 16, wherein each one of the free end latch portions is operative to pivot generally transversely away from the U-shaped recess portion in a flexed state and is resiliently biased to the normal state.

18. A terminal position assurance device according to claim 10, further comprising a guide rail extending in the longitudinal direction and disposed in at least the U-shaped recess portion of the housing cavity.

19. A connector assembly, comprising:

a terminal position assurance device including:

a housing extending along and about a longitudinal axis defining a longitudinal direction, a lateral axis defining a lateral direction and a transverse axis defining a transverse direction, the longitudinal axis, the lateral axis and the transverse axis perpendicularly intersecting one another to form a Cartesian coordinate system, the housing having a U-shaped member, a top wall, a bottom wall extending parallel to the top wall and a pair of side walls disposed apart from and extending generally parallel to one another and interconnecting the top and bottom walls to form a generally parallelepiped configuration to define a housing cavity extending in the longitudinal direction, the U-shaped member having a base extending in the transverse direction and a pair of arms extending generally parallel to each other in the lateral direction and generally perpendicularly to the base member with each arm having a fixed arm portion and a free end latch portion integrally connected to the fixed arm portion, the base integrally formed with one of the pair of side walls and respective ones of the fixed arm portions integrally formed with respective ones of the top and bottom walls, respective ones of the free end latch portions and the top and bottom walls being separated from one other by a slot formed therebetween, each one of the free end latch portions having a locking tab extending in the longitudinal direction, each one of the free end latch portions extending in the lateral and longitudinal directions and parallel to one another in a normal state and each one of the free end latch portions being operative to pivot generally transversely away from the U-shaped recess portion in a flexed state and being resiliently biased to the normal state; and a matrix body disposed in the housing cavity and having a plurality of tubes with each tube defining a passageway therethrough in the longitudinal direction, the U-shaped member disposed forward of the matrix body in the longitudinal direction to form a U-shaped recess portion of the housing cavity disposed forwardly of the matrix body, each locking tab projecting into the U-shaped recess portion, each one of the plurality of passageways defined by a series of horizontal wall sections and a series of vertical wall sections, the horizontal wall sections disposed apart from one another in the transverse direction and extending in the longitudinal and lateral directions, the series of vertical wall sections interconnecting the horizontal wall sections, being disposed apart from one another in the lateral direction and extending in the longitudinal and transverse directions, each one of the series of vertical wall sections includes a terminal retainer tab projecting laterally into a respective one of the plurality of passageways;

a terminal connector including a terminal connector housing having a parallelepiped configuration and a plurality of female terminal-receiving channel members arranged in general registration with the plurality of matrix passageways, the terminal connector having an insertion part with a wall formed with a pair of opposing guide slots, a pair of opposing first indentations and a pair of opposing second indentations, respective ones of the first and second indentations disposed apart from and extending parallel to one another in a juxtaposed manner; and a plurality of female terminals with respective ones of the female terminals disposed and retained in respective ones of the plurality of the female terminal-receiving channel members, each female terminal having a U-shaped front portion and a U-shaped stepped-down rear portion integrally connected to the U-shaped front portion to form a pair of stop walls rearwardly of the U-shaped front portion adjacent the U-shaped stepped-down rear portion, wherein, to connect the terminal position assurance device and the terminal connector together, the terminal position assurance device serially moves relative to the terminal connector from an initial alignment position, to a pre-lock position, to an initial lock position and to a final lock position such that:

in the initial alignment position, respective ones of the locking tabs are positioned to align with respective ones of the guide slots and respective ones of the plurality of matrix tubes are positioned to align with respective ones of the plurality of female terminal-receiving channel members;

in the pre-lock position, respective ones of the locking tabs are slidably received in respective ones of the guide slots, a forward portion of the insertion part is received in the U-shaped recess portion of the housing cavity and respective ones of the plurality of female terminal-receiving channel members are partially received in respective ones of the plurality of matrix tubes with respective ones of the terminal retainer tabs positioned juxtaposed to respective ones of the U-shaped front portions of the plurality of female terminals;

from the pre-lock position to the initial lock position, a first force is applied in the longitudinal direction to cause respective ones of the free end latch portions to move from the normal state to the flexed state while respective ones of the locking tabs slide along the insertion part in the longitudinal direction and to advance the plurality of matrix tubes onto the plurality of female terminal-receiving channels;

in the initial lock position, respective ones of the locking tabs are received in respective ones of the first indentations in a close-fitting relationship while respective ones of the terminal retainer tabs are rearwardly offset relative to one of the pair of stop walls in the longitudinal direction;

from the initial lock position to the final lock position, a second force is applied in the lateral direction to cause respective ones of the free end latch portions to move from the normal state to the flexed state while respective ones of the locking tabs slide along the insertion part in the lateral direction and while the respective ones of the terminal retainer tabs move in a lateral direction behind at least one of the respective pairs of stop walls; and in the final lock position, respective ones of the locking tabs are received in respective ones of the second indentations in a close-fitting relationship with the free end latch portions returning to the normal state and respective ones of the terminal retainer tabs being disposed in a stationary position behind the at least one of the respective pairs of stop walls.

* * * * *